US009280976B2

(12) United States Patent
Vasilache et al.

(10) Patent No.: US 9,280,976 B2
(45) Date of Patent: Mar. 8, 2016

(54) AUDIO SIGNAL ENCODER

(71) Applicant: Nokia Corporation, Espoo (FI)

(72) Inventors: Adriana Vasilache, Tampere (FI); Lasse Juhani Laaksonen, Nokia (JP); Anssi Sakari Rämö, Tampere (FI)

(73) Assignee: Nokia Technologies Oy, Espoo (FI)

( * ) Notice: Subject to any disclaimer, the term of this patent is extended or adjusted under 35 U.S.C. 154(b) by 155 days.

(21) Appl. No.: 14/141,377

(22) Filed: Dec. 26, 2013

(65) Prior Publication Data

US 2014/0195253 A1 Jul. 10, 2014

(30) Foreign Application Priority Data

Jan. 8, 2013 (WO) ..... PCT/IB2013/050154

(51) Int. Cl.
*G10L 19/008* (2013.01)
*G10L 19/24* (2013.01)
*G10L 19/005* (2013.01)

(52) U.S. Cl.
CPC ..... *G10L 19/008* (2013.01); *G10L 19/005* (2013.01); *G10L 19/24* (2013.01)

(58) Field of Classification Search
None
See application file for complete search history.

(56) References Cited

U.S. PATENT DOCUMENTS 6,298,071 B1 * 10/2001 Taylor et al. ..... 370/486
2006/0088093 A1 4/2006 Lakaniemi et al.
2009/0164223 A1 6/2009 Fejzo
2012/0207311 A1 8/2012 Hoang et al.

(Continued)

FOREIGN PATENT DOCUMENTS

EP 1376538 A1 1/2004
EP 1746751 A1 1/2007

(Continued)

OTHER PUBLICATIONS

Extended European Search Report received for corresponding European Patent Application No. 13196575.8, dated Aug. 4, 2014, 9 pages.

(Continued)

*Primary Examiner* — Jeremiah Bryar
(74) *Attorney, Agent, or Firm* — Nokia Technologies Oy

(57) ABSTRACT

An apparatus comprising: a coding rate determiner configured to determine a first coding bitrate for at least one first frame audio signal multi-channel parameter and a second coding bitrate for at least one second frame audio signal multi-channel parameter, wherein the combined first and second coding bitrate is less than a bitrate limit; a channel analyser configured to determine for a first frame the at least one first frame audio signal multi-channel parameter and configured to determine for a second frame the at least one second frame audio signal multi-channel parameter; a multi-channel parameter determiner configured to generate an encoded first frame audio signal multi-channel parameter within the first coding bitrate from the at least one first frame audio signal multi-channel parameter and configured to generate an encoded at least one second frame audio signal parameter within the second coding bitrate from the at least one second frame audio signal multi-channel parameter; and a multiplexer configured to combine the encoded at least one first frame audio signal multi-channel parameter and the encoded at least one second frame audio signal multi-channel parameter.

24 Claims, 12 Drawing Sheets

(56) References Cited

U.S. PATENT DOCUMENTS

| | | | | |
|---|---|---|---|---|
| 2012/0265523 | A1 | 10/2012 | Greer et al. | |
| 2012/0269353 | A1* | 10/2012 | Herre et al. | 381/22 |
| 2014/0303984 | A1* | 10/2014 | Johnson et al. | 704/500 |
| 2015/0025894 | A1* | 1/2015 | Lee et al. | 704/500 |

FOREIGN PATENT DOCUMENTS

| | | | |
|---|---|---|---|
| WO | 2007/009548 | A1 | 1/2007 |
| WO | 2009/150290 | A1 | 12/2009 |
| WO | 2011/029984 | A1 | 3/2011 |
| WO | 2012/101483 | A1 | 8/2012 |
| WO | 2013/179084 | A1 | 12/2013 |
| WO | 2014/013294 | A1 | 1/2014 |

OTHER PUBLICATIONS

International Search Report and Written Opinion received for corresponding Patent Cooperation Treaty Application No. PCT/IB2013/050154, dated Oct. 24, 2013, 14 pages.

* cited by examiner

AUDIO SIGNAL ENCODER

FIELD

The present application relates to a multichannel or stereo audio signal encoder, and in particular, but not exclusively to a multichannel or stereo audio signal encoder for use in portable apparatus.

BACKGROUND

Audio signals, like speech or music, are encoded for example to enable efficient transmission or storage of the audio signals.

Audio encoders and decoders (also known as codecs) are used to represent audio based signals, such as music and ambient sounds (which in speech coding terms can be called background noise). These types of coders typically do not utilise a speech model for the coding process, rather they use processes for representing all types of audio signals, including speech. Speech encoders and decoders (codecs) can be considered to be audio codecs which are optimised for speech signals, and can operate at either a fixed or variable bit rate.

An audio codec can also be configured to operate with varying bit rates. At lower bit rates, such an audio codec may be optimized to work with speech signals at a coding rate equivalent to a pure speech codec. At higher bit rates, the audio codec may code any signal including music, background noise and speech, with higher quality and performance. A variable-rate audio codec can also implement an embedded scalable coding structure and bitstream, where additional bits (a specific amount of bits is often referred to as a layer) improve the coding upon lower rates, and where the bitstream of a higher rate may be truncated to obtain the bitstream of a lower rate coding. Such an audio codec may utilize a codec designed purely for speech signals as the core layer or lowest bit rate coding.

An audio codec is designed to maintain a high (perceptual) quality while improving the compression ratio. Thus instead of waveform matching coding it is common to employ various parametric schemes to lower the bit rate. For multichannel audio, such as stereo signals, it is common to use a larger amount of the available bit rate on a mono channel representation and encode the stereo or multichannel information exploiting a parametric approach which uses relatively fewer bits.

SUMMARY

There is provided according to a first aspect a method comprising: determining a first coding bitrate for at least one first frame audio signal multi-channel parameter and a second coding bitrate for at least one second frame audio signal multi-channel parameter, wherein the combined first and second coding bitrate is less than a bitrate limit; determining for a first frame the at least one first frame audio signal multi-channel parameter; generating an encoded first frame audio signal multi-channel parameter within the first coding bitrate from the at least one first frame audio signal multi-channel parameter; determining for a second frame the at least one second frame audio signal multi-channel parameter; generating an encoded at least one second frame audio signal multi-channel parameter within the second coding bitrate from the at least one second frame audio signal multi-channel parameter; and combining the encoded at least one first frame audio signal multi-channel parameter and the encoded at least one second frame audio signal multi-channel parameter.

The first frame may be at least one of: adjacent to the second frame; and preceding the second frame.

Determining for a first frame the at least one first frame audio signal multi-channel parameter or determining for a second frame the at least one second frame audio signal multi-channel parameter may comprise determining at least one of: at least one interaural time difference; and at least one interaural level difference.

Generating an encoded first frame audio signal multi-channel parameter within the first coding bitrate from the at least one first frame audio signal multi-channel parameter or generating an encoded second frame audio signal multi-channel parameter within the second coding bitrate from the at least one second frame audio signal multi-channel parameter may comprise: generating codebook indices for groups of the at least one first frame audio signal multi-channel parameter or the at least one second frame audio signal multi-channel parameter respectively using separate vector quantization codebooks; generating a combined vector quantization codebook from the separate quantization codebooks; and generating a combined vector quantization index for the combined vector quantization codebook from the codebook indices for groups, wherein the number of bits used to identify the combined vector quantization index is fewer than a combined number of bits used by the codebook indices for the separate groups.

Generating a combined vector quantization codebook from the separate quantization codebooks may comprise: selecting from the separate vector quantization codebooks at least one codevector; and combining the at least one codevector from the separate vector quantization codebooks.

Selecting from the separate vector quantization codebooks at least one codevector may comprise: determining a first number of codevectors to be selected from the separate vector quantization codebooks; and increasing the first number until the first or second respective encoding bitrate is reached.

Generating an encoded first frame audio signal multi-channel parameter within the first coding bitrate from the at least one first frame audio signal multi-channel parameter may comprise: generating a first encoding mapping with an associated index for the at least one first frame audio signal multi-channel parameter dependent on a frequency distribution of mapping instances of the at least one first frame audio signal multi-channel parameter; and encoding the first encoding mapping dependent on the associated index.

Encoding the first encoding mapping dependent on the associated index may comprise applying a Golomb-Rice encoding to the first encoding mapping dependent on the associated index.

Generating an encoded second frame audio signal multi-channel parameter within the second coding bitrate from the at least one second frame audio signal multi-channel parameter may comprise: generating a second encoding mapping with an associated index for the at least one second frame audio signal multi-channel parameter dependent on a frequency distribution of mapping instances of the at least one second frame audio signal multi-channel parameter; and encoding the second encoding mapping dependent on the associated index.

Encoding the second encoding mapping dependent on the associated index may comprise applying a Golomb-Rice encoding to the second encoding mapping dependent on the associated index.

The method may further comprise: receiving two or more audio signal channels; determining a fewer number of channels audio signal from the two or more audio signal channels and the at least one first frame audio signal multi-channel parameter; generating an encoded audio signal comprising the fewer number of channels within a packet bitrate limit; combining the encoded audio signal, the encoded at least one first frame audio signal multi-channel parameter and the encoded at least one second frame audio signal multi-channel parameter.

The second coding bitrate may be less than the first coding bitrate.

According to a second aspect there is provided a method comprising: receiving within a first period an encoded audio signal comprising at least one first frame audio signal, at least one first frame audio signal multi-channel parameter and at least one further frame audio signal multi-channel parameter and receiving within a further period a further encoded audio signal comprising at least one further frame audio signal; determining whether the further encoded audio signal comprises at least one further frame audio signal multi-channel parameter and/or the at least one further frame audio signal multi-channel parameter is corrupted; and generating for the further frame at least two channel audio signals from either of the at least one first frame audio signal or the at least one further frame audio signal, and the encoded audio signal at least one further frame audio signal multi-channel parameter when the further encoded audio signal does not comprise at least one further frame audio signal multi-channel parameter or the at least one further frame audio signal multi-channel parameter is corrupted.

The method may further comprise generating for the further frame at least two channel audio signals from the at least one further frame audio signal and the further encoded audio signal at least one further frame audio signal multi-channel parameter when the further encoded audio signal comprises the at least one further frame audio signal multi-channel parameter and the at least one further frame audio signal multi-channel parameter is not corrupted.

According to a third aspect there is provided an apparatus comprising at least one processor and at least one memory including computer program code for one or more programs, the at least one memory and the computer program code configured to, with the at least one processor, cause the apparatus at least to: determine a first coding bitrate for at least one first frame audio signal multi-channel parameter and a second coding bitrate for at least one second frame audio signal multi-channel parameter, wherein the combined first and second coding bitrate is less than a bitrate limit; determine for a first frame the at least one first frame audio signal multi-channel parameter; generate an encoded first frame audio signal multi-channel parameter within the first coding bitrate from the at least one first frame audio signal multi-channel parameter; determine for a second frame the at least one second frame audio signal multi-channel parameter; generate an encoded at least one second frame audio signal multi-channel parameter within the second coding bitrate from the at least one second frame audio signal multi-channel parameter; and combine the encoded at least one first frame an audio signal multi-channel parameter and the encoded at least one second frame audio signal multi-channel parameter.

The first frame may be at least one of: adjacent to the second frame; and preceding the second frame.

Determining for a first frame the at least one first frame audio signal multi-channel parameter or determining for a second frame the at least one second frame audio signal multi-channel parameter may cause the apparatus to determine at least one of: at least one interaural time difference; and at least one interaural level difference.

Generating an encoded first frame audio signal multi-channel parameter within the first coding bitrate from the at least one first frame audio signal multi-channel parameter or generating an encoded second frame audio signal multi-channel parameter within the second coding bitrate from the at least one second frame audio signal multi-channel parameter may cause the apparatus to: generate codebook indices for groups of the at least one first frame audio signal multi-channel parameter or the at least one second frame audio signal multi-channel parameter respectively using separate vector quantization codebooks; generate a combined vector quantization codebook from the separate quantization codebooks; and generate a combined vector quantization index for the combined vector quantization codebook from the codebook indices for groups, wherein the number of bits used to identify the combined vector quantization index is fewer than a combined number of bits used by the codebook indices for the separate groups.

Generating a combined vector quantization codebook from the separate quantization codebooks may cause the apparatus to: select from the separate vector quantization codebooks at least one codevector; and combine the at least one codevector from the separate vector quantization codebooks.

Selecting from the separate vector quantization codebooks at least one codevector may cause the apparatus to: determine a first number of codevectors to be selected from the separate vector quantization codebooks; and increase the first number until the first or second respective encoding bitrate is reached.

Generating an encoded first frame audio signal multi-channel parameter within the first coding bitrate from the at least one first frame audio signal multi-channel parameter may cause the apparatus to: generate a first encoding mapping with an associated index for the at least one first frame audio signal multi-channel parameter dependent on a frequency distribution of mapping instances of the at least one first frame audio signal multi-channel parameter; and encode the first encoding mapping dependent on the associated index.

Encoding the first encoding mapping dependent on the associated index may cause the apparatus to apply a Golomb-Rice encoding to the first encoding mapping dependent on the associated index.

Generating an encoded second frame audio signal multi-channel parameter within the second coding bitrate from the at least one second frame audio signal multi-channel parameter may cause the apparatus to: generate a second encoding mapping with an associated index for the at least one second frame audio signal multi-channel parameter dependent on a frequency distribution of mapping instances of the at least one second frame audio signal multi-channel parameter; and encode the second encoding mapping dependent on the associated index.

Encoding the second encoding mapping dependent on the associated index may cause the apparatus to apply a Golomb-Rice encoding to the second encoding mapping dependent on the associated index.

The apparatus may further be caused to: receive two or more audio signal channels; determine a fewer number of channels audio signal from the two or more audio signal channels and the at least one first frame audio signal multi-channel parameter; generate an encoded audio signal within a packet bitrate limit; combine the encoded audio signal, the encoded at least one first frame audio signal multi-channel parameter and the encoded at least one second frame audio signal multi-channel parameter.

According to a fourth aspect there is provided an apparatus comprising at least one processor and at least one memory including computer program code for one or more programs, the at least one memory and the computer program code configured to, with the at least one processor, cause the apparatus at least to: receive within a first period an encoded audio signal comprising at least one first frame audio signal, at least one first frame audio signal multi-channel parameter and at least one further frame audio signal multi-channel parameter and receive within a further period a further encoded audio signal comprising at least one further frame audio signal; determine whether the further encoded audio signal comprises at least one further frame audio signal multi-channel parameter and/or the at least one further frame audio signal multi-channel parameter is corrupted; and generate for the further frame at least two channel audio signals from either of the at least one first frame audio signal or the at least one further frame audio signal, and the encoded audio signal at least one further frame audio signal multi-channel parameter when the further encoded audio signal does not comprise at least one further frame audio signal multi-channel parameter or the at least one further frame audio signal multi-channel parameter is corrupted.

The apparatus may further be caused to generate for the further frame at least two channel audio signals from the at least one further frame audio signal and the further encoded audio signal at least one further frame audio signal multi-channel parameter when the further encoded audio signal comprises the at least one further frame audio signal multi-channel parameter and the at least one further frame audio signal multi-channel parameter is not corrupted.

According to a fifth aspect there is provided an apparatus comprising: means for determining a first coding bitrate for at least one first frame audio signal multi-channel parameter and a second coding bitrate for at least one second frame audio signal multi-channel parameter, wherein the combined first and second coding bitrate is less than a bitrate limit; means for determining for a first frame the at least one first frame audio signal multi-channel parameter; means for generating an encoded first frame audio signal multi-channel parameter within the first coding bitrate from the at least one first frame audio signal multi-channel parameter; means for determining for a second frame the at least one second frame audio signal multi-channel parameter; means for generating an encoded at least one second frame audio signal multi-channel parameter within the second coding bitrate from the at least one second frame audio signal multi-channel parameter; and means for combining the encoded at least one first frame audio signal multi-channel parameter and the encoded at least one second frame audio signal multi-channel parameter.

The first frame may be at least one of: adjacent to the second frame; and preceding the second frame.

The means for determining for a first frame the at least one first frame audio signal multi-channel parameter or means for determining for a second frame the at least one second frame audio signal multi-channel parameter may comprise means for determining at least one of: at least one interaural time difference; and at least one interaural level difference.

The means for generating an encoded first frame audio signal multi-channel parameter within the first coding bitrate from the at least one first frame audio signal multi-channel parameter or means for generating an encoded second frame audio signal multi-channel parameter within the second coding bitrate from the at least one second frame audio signal multi-channel parameter may comprise: means for generating codebook indices for groups of the at least one first frame audio signal multi-channel parameter or the at least one second frame audio signal multi-channel parameter respectively using separate vector quantization codebooks; means for generating a combined vector quantization codebook from the separate quantization codebooks; and means for generating a combined vector quantization index for the combined vector quantization codebook from the codebook indices for groups, wherein the number of bits used to identify the combined vector quantization index is fewer than a combined number of bits used by the codebook indices for the separate groups.

The means for generating a combined vector quantization codebook from the separate quantization codebooks may comprise: means for selecting from the separate vector quantization codebooks at least one codevector; and means for combining the at least one codevector from the separate vector quantization codebooks.

The means for selecting from the separate vector quantization codebooks at least one codevector may comprise: means for determining a first number of codevectors to be selected from the separate vector quantization codebooks; and means for increasing the first number until the first or second respective encoding bitrate is reached.

The means for generating an encoded first frame audio signal multi-channel parameter within the first coding bitrate from the at least one first frame audio signal multi-channel parameter may comprise: means for generating a first encoding mapping with an associated index for the at least one first frame audio signal multi-channel parameter dependent on a frequency distribution of mapping instances of the at least one first frame audio signal multi-channel parameter; and means for encoding the first encoding mapping dependent on the associated index.

The means for encoding the first encoding mapping dependent on the associated index comprises means for applying a Golomb-Rice encoding to the first encoding mapping dependent on the associated index.

The means for generating an encoded second frame audio signal multi-channel parameter within the second coding bitrate from the at least one second frame audio signal multi-channel parameter may comprise: means for generating a second encoding mapping with an associated index for the at least one second frame audio signal multi-channel parameter dependent on a frequency distribution of mapping instances of the at least one second frame audio signal multi-channel parameter; and means for encoding the second encoding mapping dependent on the associated index.

The means for encoding the second encoding mapping dependent on the associated index may comprise means for applying a Golomb-Rice encoding to the second encoding mapping dependent on the associated index.

The apparatus may further comprise: means for receiving at least two audio signal channels; means for determining a fewer number of channels audio signal from the at least two audio signal channels and the at least one first frame audio signal multi-channel parameter; means for generating an encoded audio signal within a packet bitrate limit; and means for combining the encoded audio signal, the encoded at least one first frame audio signal multi-channel parameter and the encoded at least one second frame audio signal multi-channel parameter.

According to a sixth aspect there is provided an apparatus comprising: means for receiving within a first period a encoded audio signal comprising at least one first frame audio signal, at least one first frame audio signal multi-channel parameter and at least one further frame audio signal multi-channel parameter and for receiving within a further period a further encoded audio signal comprising at least one further frame audio signal; means for determining whether the further encoded audio signal comprises at least one further frame audio signal multi-channel parameter and/or the at least one further frame audio signal multi-channel parameter is corrupted; and means for generating for the further frame at least two channel audio signals from either of the at least one first frame audio signal or the at least one further audio signal, and the encoded audio signal at least one further frame audio signal multi-channel parameter when the further encoded audio signal does not comprise at least one further frame audio signal multi-channel parameter or the at least one further frame audio signal multi-channel parameter is corrupted.

The apparatus may further comprise means for generating for the further frame at least two channel audio signals from the at least one further frame audio signal and the further encoded audio signal at least one further frame audio signal multi-channel parameter when the further encoded audio signal comprises the at least one further frame audio signal multi-channel parameter and the at least one further frame audio signal multi-channel parameter is not corrupted.

According to a seventh aspect there is provided an apparatus comprising: a coding rate determiner configured to determine a first coding bitrate for at least one first frame audio signal multi-channel parameter and a second coding bitrate for at least one second frame audio signal multi-channel parameter, wherein the combined first and second coding bitrate is less than a bitrate limit; a channel analyser configured to determine for a first frame the at least one first frame audio signal multi-channel parameter and configured to determine for a second frame the at least one second frame audio signal multi-channel parameter; a multi-channel parameter determiner configured to generate an encoded first frame audio signal multi-channel parameter within the first coding bitrate from the at least one first frame audio signal multi-channel parameter and configured to generate an encoded at least one second frame audio signal parameter within the second coding bitrate from the at least one second frame audio signal multi-channel parameter; and a multiplexer configured to combine the encoded at least one first frame audio signal multi-channel parameter and the encoded at least one second frame audio signal multi-channel parameter.

The first frame may be at least one of: adjacent to the second frame; and preceding the second frame.

The channel analyser may be configured to determine at least one of: at least one interaural time difference; and at least one interaural level difference.

The multi-channel parameter determiner may comprise: an codebook quantizer encoder configured to generate codebook indices for groups of the at least one first frame audio signal multi-channel parameter or the at least one second frame audio signal multi-channel parameter respectively using separate vector quantization codebooks; a codebook combiner configured to generate a combined vector quantization codebook from the separate quantization codebooks; and an index mapper configured to generate a combined vector quantization index for the combined vector quantization codebook from the codebook indices for groups, wherein the number of bits used to identify the combined vector quantization index is fewer than a combined number of bits used by the codebook indices for the separate groups.

The codebook combiner may comprise: a codevector selector configured to select from the separate vector quantization codebooks at least one codevector; and codevector combiner configured to combine the at least one codevector from the separate vector quantization codebooks.

The codevector selector may comprise: a codevector number determiner configured to determine a first number of codevectors to be selected from the separate vector quantization codebooks; and codevector selector optimizer configured to increase the first number until the first or second respective encoding bitrate is reached.

The multi-channel parameter determiner may comprise: a mapper configured to generate a first encoding mapping with an associated index for the at least one first frame audio signal multi-channel parameter dependent on a frequency distribution of mapping instances of the at least one first frame audio signal multi-channel parameter; and an encoder configured to encode the first encoding mapping dependent on the associated index.

The encoder may comprise a Golomb-Rice encoder.

The multi-channel parameter determiner may comprise: a second mapper configured to generate a second encoding mapping with an associated index for the at least one second frame audio signal multi-channel parameter dependent on a frequency distribution of mapping instances of the at least one second frame audio signal multi-channel parameter; and a second encoder configured to encode the second encoding mapping dependent on the associated index.

The second encoder may comprise a Golomb-Rice encoder.

The apparatus may further comprise: an input configured to receive at least two audio signal channels; a mono audio signal generator configured to determine a fewer number of channels audio signal from the at least two audio signal channels and the at least one first frame audio signal multi-channel parameter; an audio signal encoder configured to generate an encoded audio signal within a packet bitrate limit; and an audio signal combiner configured to combine the encoded audio signal, the encoded at least one first frame audio signal multi-channel parameter and the encoded at least one second frame audio signal multi-channel parameter.

According to an eighth aspect there is provided an apparatus comprising: an input configured to receive within a first period a encoded audio signal comprising at least one first frame audio signal, at least one first frame audio signal multi-channel parameter and at least one further frame audio signal multi-channel parameter and receive within a further period a further encoded audio signal comprising at least one further frame audio signal; a packet analyser configured to determine whether the further encoded audio signal comprises at least one further frame audio signal multi-channel parameter and/or the at least one further frame audio signal multi-channel parameter is corrupted; and a stereo channel generator configured to generate for the further frame at least two channel audio signals from either of the at least one first frame audio signal or the at least one further frame audio signal, and the encoded audio signal at least one further frame audio signal multi-channel parameter when the further encoded audio signal does not comprise at least one further frame audio signal multi-channel parameter or the at least one further frame audio signal multi-channel parameter is corrupted.

The stereo channel generator may further be configured to generate for the further frame at least two channel audio signals from the at least one further frame audio signal and the further encoded audio signal at least one further frame audio signal multi-channel parameter when the further encoded audio signal comprises the at least one further frame audio signal multi-channel parameter and the at least one further frame audio signal multi-channel parameter is not corrupted.

The second coding bitrate may be less than the first coding bitrate.

A computer program product may cause an apparatus to perform the method as described herein.

An electronic device may comprise apparatus as described herein.

A chipset may comprise apparatus as described herein.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

The following describes in more detail possible stereo and multichannel speech and audio codecs, including layered or scalable variable rate speech and audio codecs. There can be a problem with current audio codec approaches in that aiming to increase the quality of the encoded signal through coding efficiency, bandwidth, as well as the number of channels any frame errors can cause problems. These problems are specifically an issue for transmission of the encoded audio signals over packet-based networks.

Coping with frame loss in the case of multichannel or stereo parameters (or generally parameters corresponding to channel extensions) has not been significantly researched and currently a frame loss or corruption causes an effective stereo or binaural parameter loss. Approaches to mitigate such a loss are frame interleaving and forward error concealment applied at a real-time protocol (RTP) level and thus applied to all of the content. Otherwise the decoder can be caused to insert a zero value or repeat a previous frame stereo parameter.

The concept for the embodiments as described herein is to attempt to generate a stereo or multichannel audio coding that produces efficient high quality and low bit rate stereo (or multichannel) signal coding yet maintains a parameter error concealment or parameter frame corruption concealment.

The concept for the embodiments as described herein is thus to use the variable bit rate coding of the stereo (or binaural or multichannel) parameters such that any remaining bits with respect to the total available fixed bit rate can be used to encode stereo (or binaural or multichannel) parameters from an adjacent frame, such as the next frame.

The availability of the binaural parameters for the adjacent frame (such as the next frame) is ensured by using a frame delay difference between the binaural extension and the core codec. Thus in the embodiments as described herein as the coding of the binaural, stereo, or multichannel parameters is bit rate scalable, the same process or apparatus can be used for encoding the next frame parameters but using a lower resolution representation.

Figure 1:
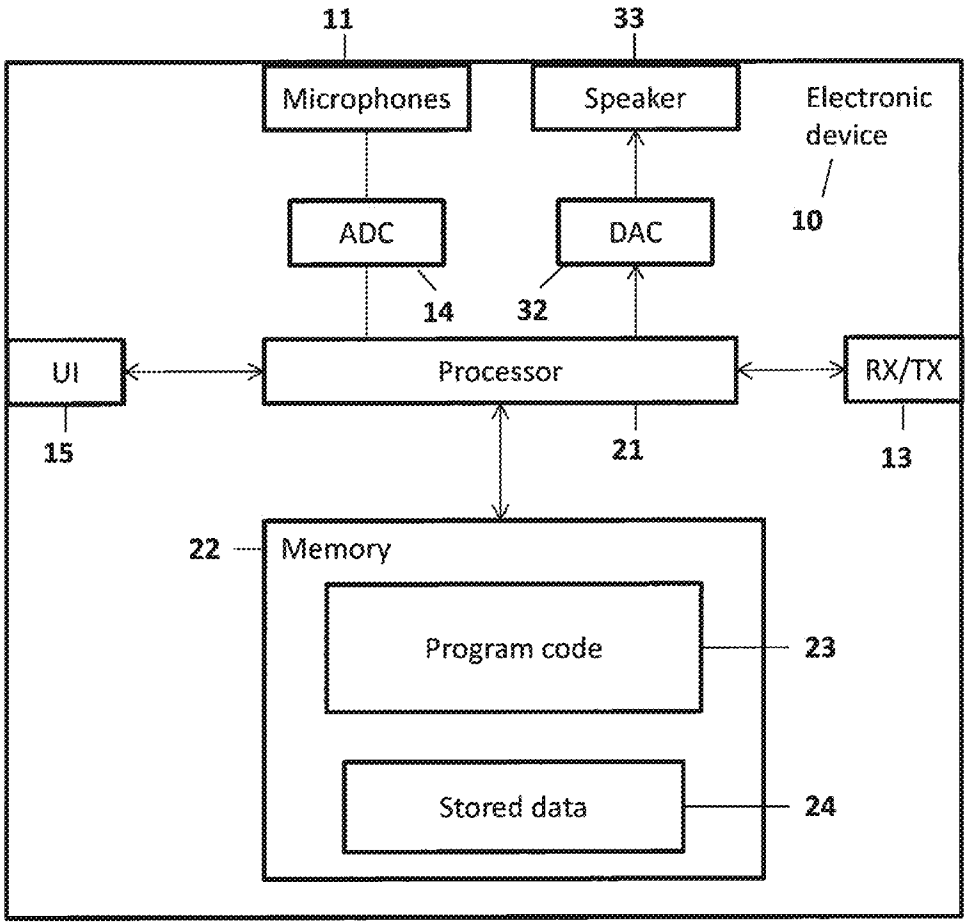
FIG. 1 shows schematically an electronic device employing some embodiments.

In this regard reference is first made to FIG. 1 which shows a schematic block diagram of an exemplary electronic device or apparatus 10, which may incorporate a codec according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise a multichannel or stereo encoding or decoding code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The encoding and decoding code in embodiments can be implemented in hardware and/or firmware.

The user interface 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver 13 suitable for enabling communication with other apparatus, for example via a wireless communication network.

It is to be understood again that the structure of the apparatus 10 could be supplemented and varied in many ways.

A user of the apparatus 10 for example can use the microphone 11 for inputting speech or other audio signals that are to be transmitted to some other apparatus or that are to be stored in the data section 24 of the memory 22. A corresponding application in some embodiments can be activated to this end by the user via the user interface 15. This application in these embodiments can be performed by the processor 21, causes the processor 21 to execute the encoding code stored in the memory 22.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

Figure 10:
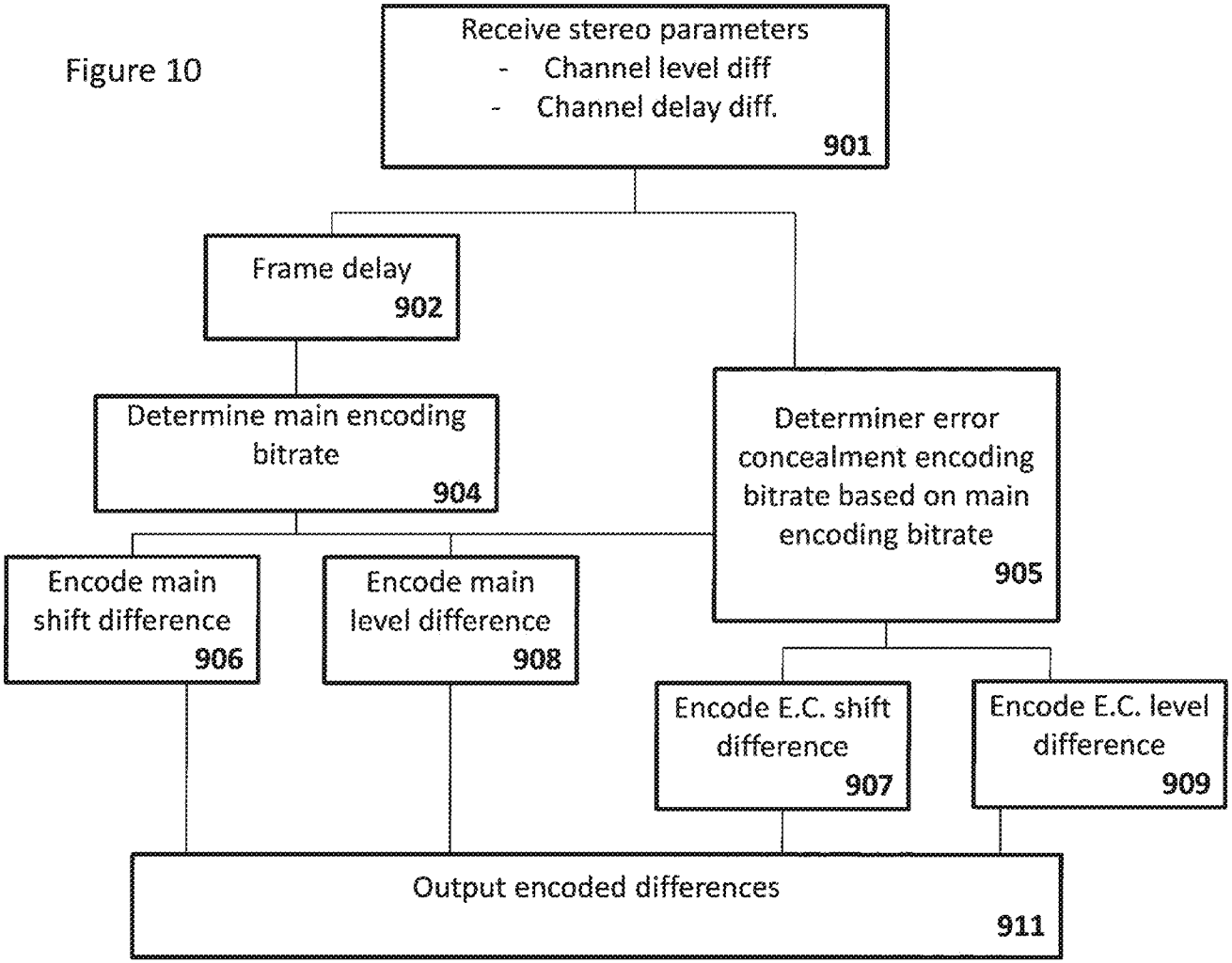
FIG. 10 shows a flow diagram illustrating the operation of the main and error concealment stereo parameter encoders as shown in FIGS. 8 and 9 according to some embodiments.
Figure 11:
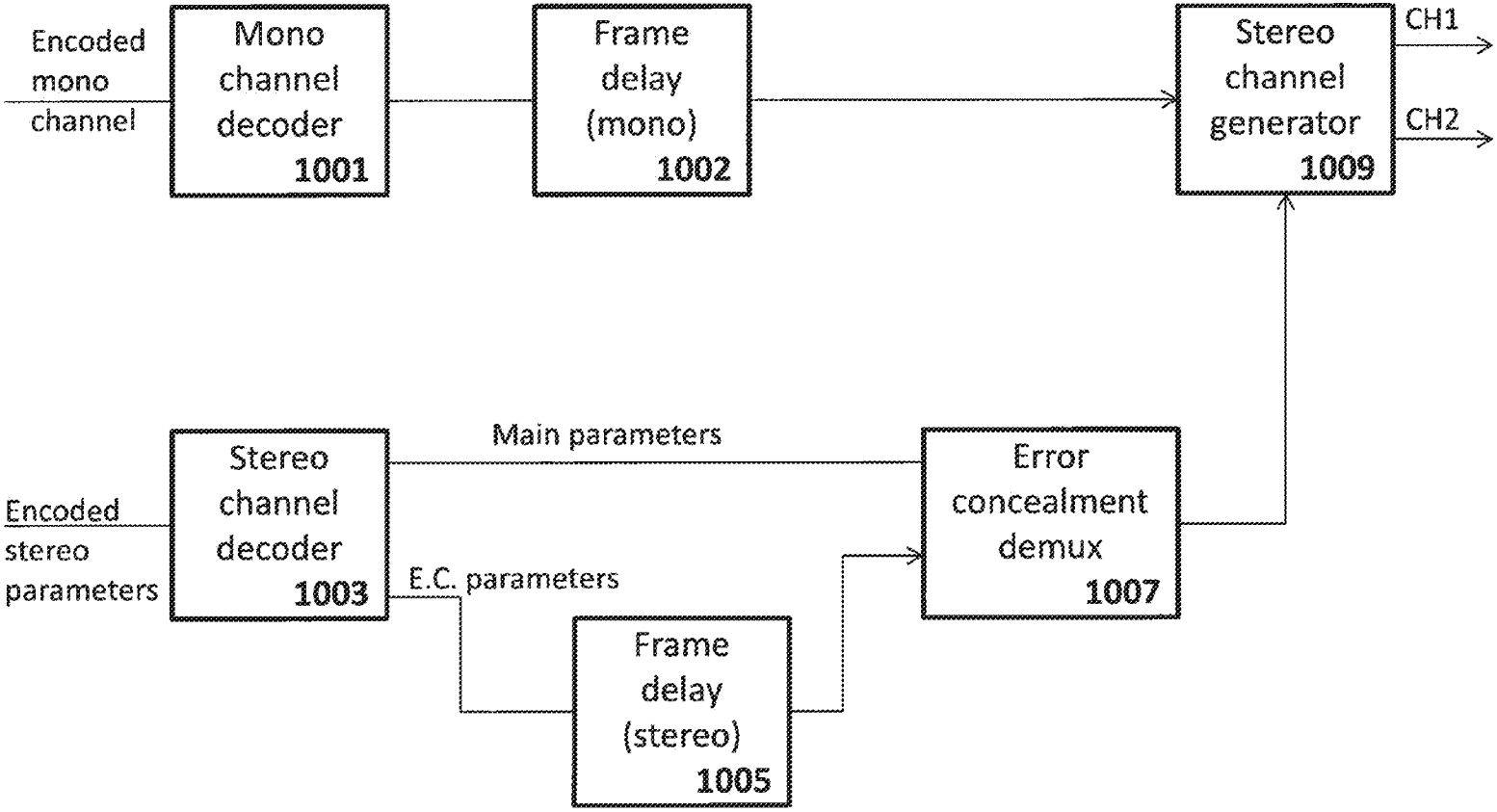
FIG. 11 shows schematically a decoder as shown in FIG. 2 according to some embodiments.
Figure 12:
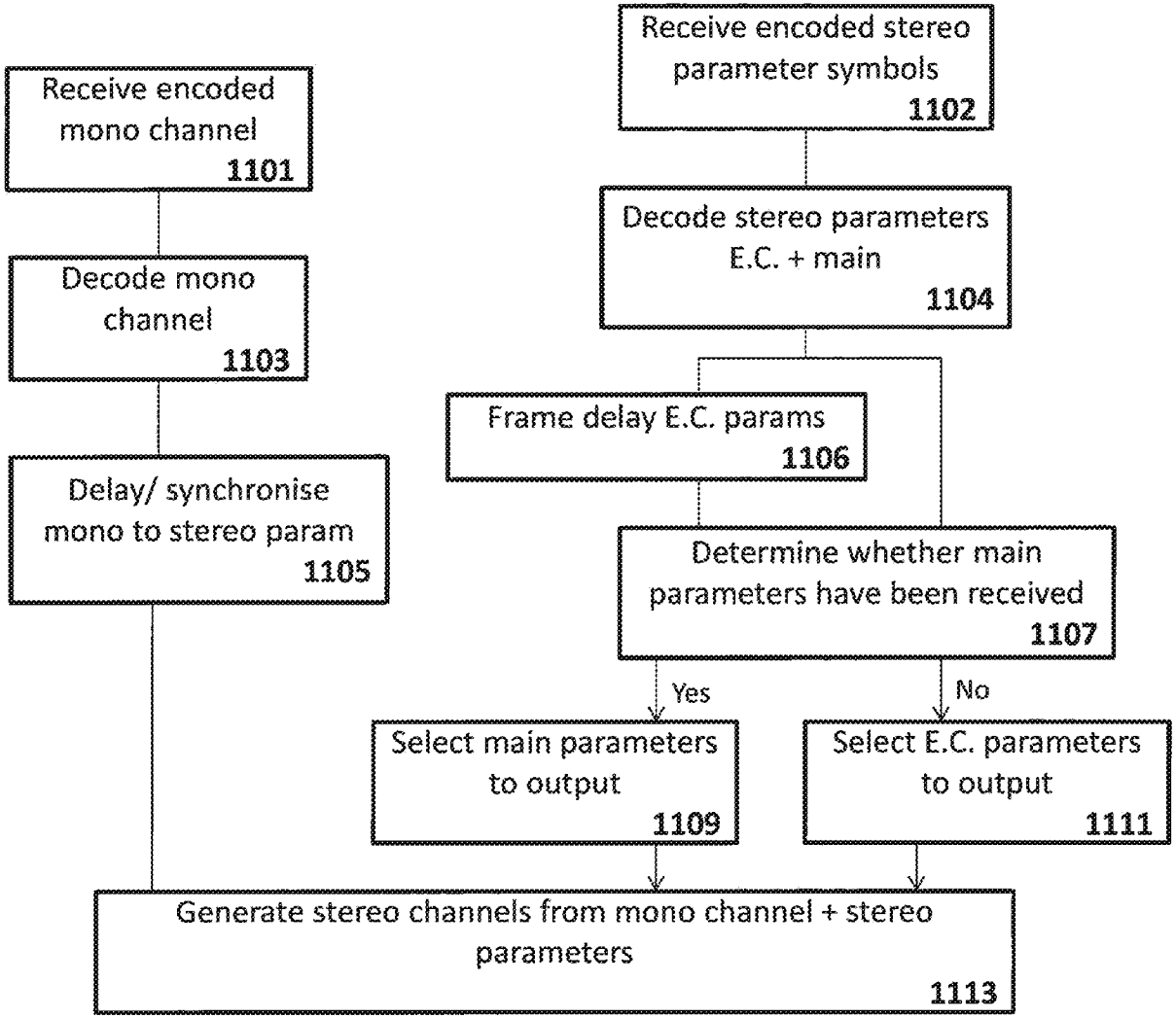
FIG. 12 shows a flow diagram illustrating the operation of the decoder as shown in FIG. 11 according to some embodiments.

The processor 21 in such embodiments then processes the digital audio signal in the same way as described with reference to the system shown in FIG. 2, the encoder shown in FIGS. 3 to 10 and the decoder as shown in FIGS. 11 and 12.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiment can also be stored instead of an immediate presentation via the loudspeakers 33 in the data section 24 of the memory 22, for instance for later decoding and presentation or decoding and forwarding to still another apparatus.

It would be appreciated that the schematic structures described in FIGS. 3 to 5, 8, 9 and 11, and the method steps shown in FIGS. 6 to 7, 10 and 12 represent only a part of the operation of an audio codec and specifically part of a stereo encoder/decoder apparatus or method as exemplarily shown implemented in the apparatus shown in FIG. 1.

Figure 2:
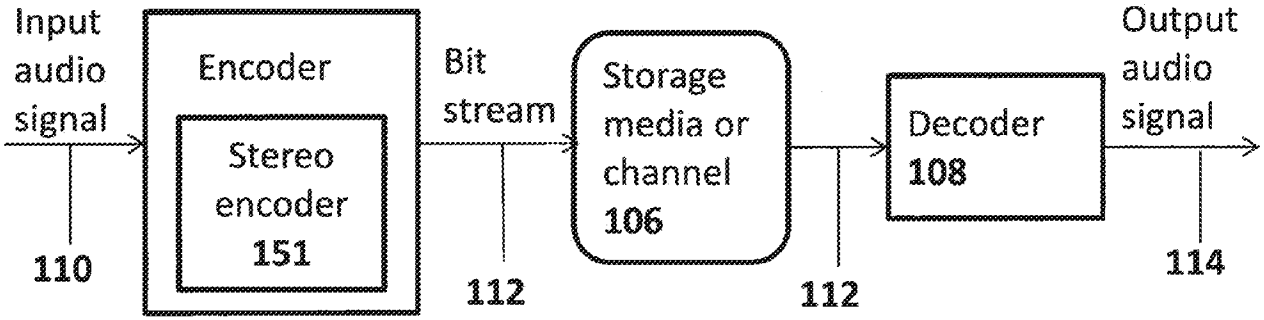
FIG. 2 shows schematically an audio codec system according to some embodiments.

The general operation of audio codecs as employed by embodiments is shown in FIG. 2. General audio coding/decoding systems comprise both an encoder and a decoder, as illustrated schematically in FIG. 2. However, it would be understood that some embodiments can implement one of either the encoder or decoder, or both the encoder and decoder. Illustrated by FIG. 2 is a system 102 with an encoder 104 and in particular a stereo encoder 151, a storage or media channel 106 and a decoder 108. It would be understood that as described above some embodiments can comprise or implement one of the encoder 104 or decoder 108 or both the encoder 104 and decoder 108.

The encoder 104 compresses an input audio signal 110 producing a bit stream 112, which in some embodiments can be stored or transmitted through a media channel 106. The encoder 104 furthermore can comprise a stereo encoder 151 as part of the overall encoding operation. It is to be understood that the stereo encoder may be part of the overall encoder 104 or a separate encoding module. The encoder 104 can also comprise a multi-channel encoder that encodes more than two audio signals.

The bit stream 112 can be received within the decoder 108. The decoder 108 decompresses the bit stream 112 and produces an output audio signal 114. The decoder 108 can comprise a stereo decoder as part of the overall decoding operation. It is to be understood that the stereo decoder may be part of the overall decoder 108 or a separate decoding module. The decoder 108 can also comprise a multi-channel decoder that decodes more than two audio signals. The bit rate of the bit stream 112 and the quality of the output audio signal 114 in relation to the input signal 110 are the main features which define the performance of the coding system 102.

Figure 3:
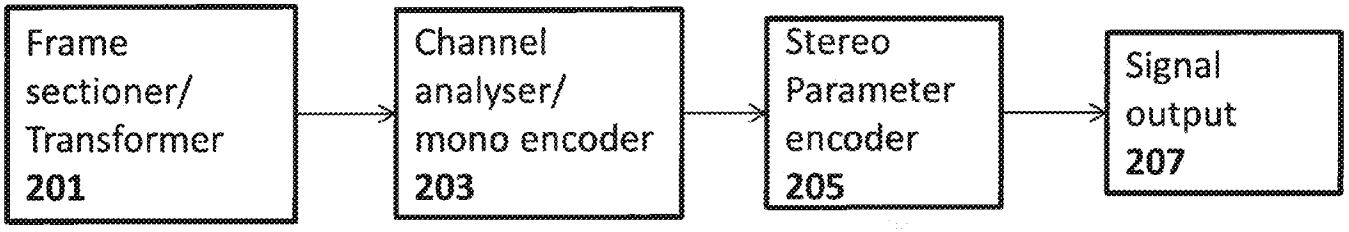
FIG. 3 shows schematically an encoder as shown in FIG. 2 according to some embodiments.

FIG. 3 shows schematically the encoder 104 according to some embodiments.

Figure 6:
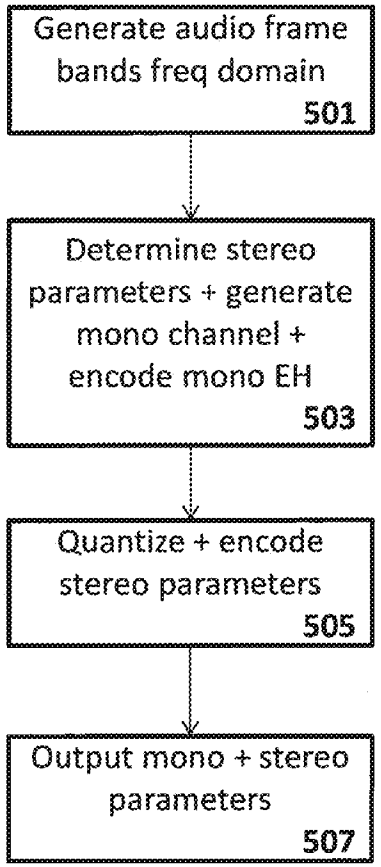
FIG. 6 shows a flow diagram illustrating the operation of the encoder shown in FIG. 3 according to some embodiments.

FIG. 6 shows schematically in a flow diagram the operation of the encoder 104 according to some embodiments.

The concept for the embodiments as described herein is to determine and apply a stereo coding mode to produce efficient high quality and low bit rate real life stereo signal coding with error concealment. To that respect with respect to FIG. 3 an example encoder 104 is shown according to some embodiments. Furthermore with respect to FIG. 6 the operation of the encoder 104 is shown in further detail.

The encoder 104 in some embodiments comprises a frame sectioner/transformer 201. The frame sectioner/transformer 201 is configured to receive the left and right (or more generally any multi-channel audio representation) input audio signals and generate frequency domain representations of these audio signals to be analysed and encoded. These frequency domain representations can be passed to the channel parameter determiner 203.

In some embodiments the frame sectioner/transformer can be configured to section or segment the audio signal data into sections or frames suitable for frequency domain transformation. The frame sectioner/transformer 201 in some embodiments can further be configured to window these frames or sections of audio signal data according to any suitable windowing function. For example the frame sectioner/transformer 201 can be configured to generate frames of 20 ms which overlap preceding and succeeding frames by 10 ms each.

In some embodiments the frame sectioner/transformer can be configured to perform any suitable time to frequency domain transformation on the audio signal data. For example the time to frequency domain transformation can be a discrete Fourier transform (DFT), Fast Fourier transform (FFT), modified discrete cosine transform (MDCT). In the following examples a Fast Fourier Transform (FFT) is used. Furthermore the output of the time to frequency domain transformer can be further processed to generate separate frequency band domain representations (sub-band representations) of each input channel audio signal data. These bands can be arranged in any suitable manner. For example these bands can be linearly spaced, or be perceptual or psychoacoustically allocated.

The operation of generating audio frame band frequency domain representations is shown in FIG. 6 by step 501.

In some embodiments the frequency domain representations are passed to a channel analyser/mono encoder 203.

In some embodiments the encoder 104 can comprise a channel analyser/mono encoder 203. The channel analyser/mono encoder 203 can be configured to receive the sub-band filtered representations of the multi-channel or stereo input. The channel analyser/mono encoder 203 can furthermore in some embodiments be configured to analyse the frequency domain audio signals and determine parameters associated with each sub-band with respect to the stereo or multi-channel audio signal differences. Furthermore the channel analyser/mono encoder can use these parameters and generate a mono channel which can be encoded according to any suitable encoding.

The stereo parameters and the mono encoded signal (or more generally the multi-channel parameters and the reduced channels encoded signal) can be output to the stereo parameter encoder 205. In the examples described herein the multi-channel parameters are defined with respect to frequency domain parameters, however time domain or other domain parameters can in some embodiments be generated.

The operation of determining the stereo parameters and generating the mono channel and encoding the mono channel is shown in FIG. 6 by step 503.

Figure 4:
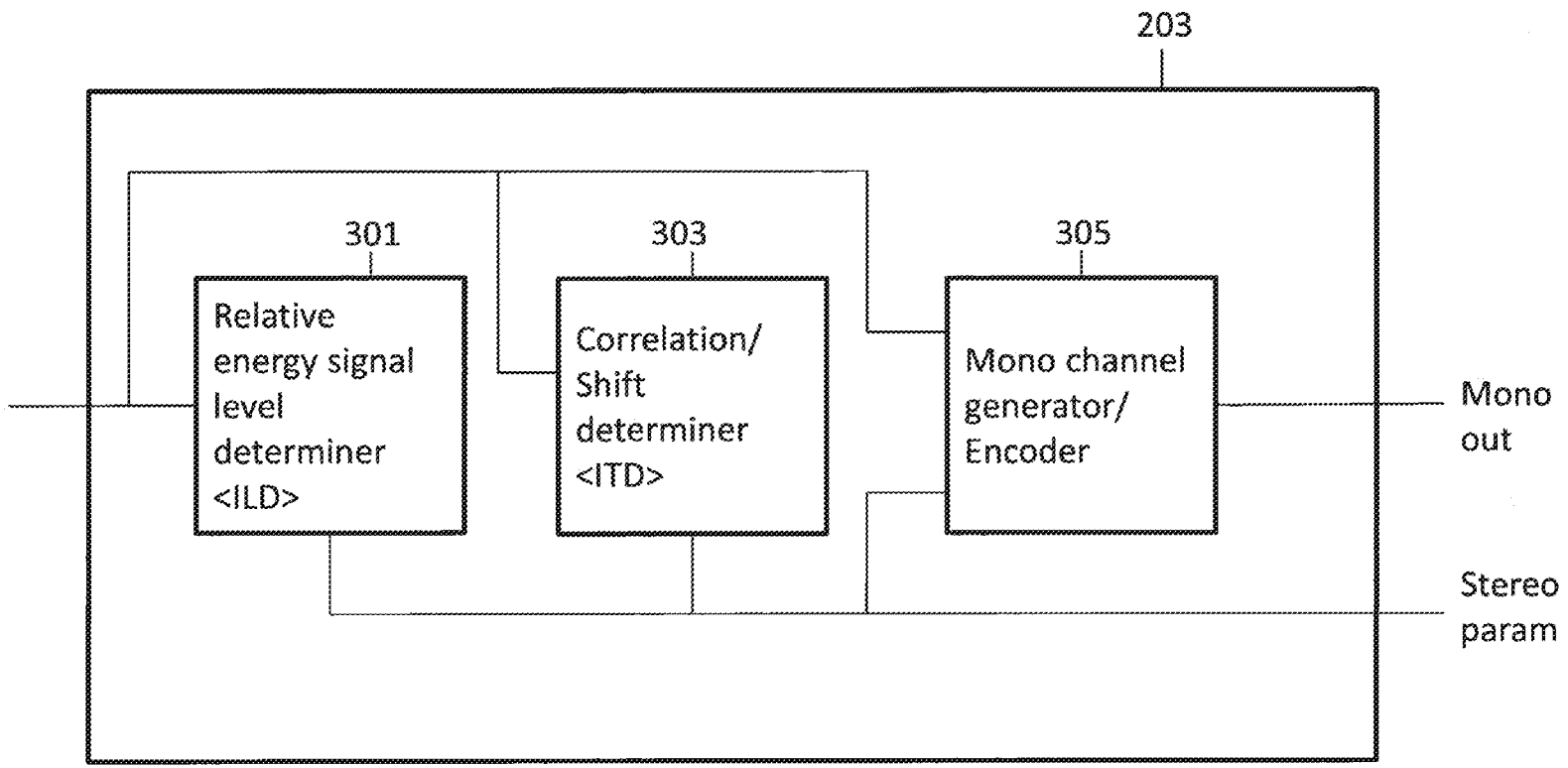
FIG. 4 shows schematically a channel analyser as shown in FIG. 3 in further detail according to some embodiments.

With respect to FIG. 4 an example channel analyser/mono encoder 203 according to some embodiments is described in further detail. Furthermore with respect to FIG. 7 the operation of the channel analyser/mono encoder 203 as shown in FIG. 4 is shown according to some embodiments.

In some embodiments the channel analyser/mono encoder 203 comprises a correlation/shift determiner 301. The correlation/shift determiner 301 is configured to determine the correlation or shift per sub-band between the two channels (or parts of multi-channel audio signals). The shifts (or the best correlation indices COR_IND[j]) can be determined for example using the following code.

```
for ( j = 0; NUM__OF__BANDS__FOR__COR__SEARCH; j++ )
{
    cor = COR__INIT;
    for ( n = 0; n < 2*MAXSHIFT + 1; n++ )
    {
        mag[n] = 0.0f;
        for ( k = COR__BAND__START[j]; k <
        COR__BAND__START[j+1]; k+ )
        {
            mag[n] += svec__re[k] * cos( −2*PI*((n−MAXSHIFT) *
            k / L__FFT );
            mag[n] −= svec__im[k] * sin( −2*PI*((n−MAXSHIFT) *
            k / L__FFT );
        }
        if (mag[n] > cor)
        {
            cor__ind[j] = n − MAXSHIFT;
            cor = mag[n];
        }
    }
}
```

Where the value MAXSHIFT is the largest allowed shift (the value can be based on a model of the supported microphone arrangements or more simply the distance between the microphones) PI is π, COR_INIT is the initial correlation value or a large negative value to initialise the correlation calculation, and COR_BAND_START [ ] defines the starting points of the sub-bands. The vectors svec_re [ ] and svec_im [ ], the real and imaginary values for the vector, used herein are defined as follows:

```
svec__re[0] = fft__l[0] * fft__r[0];
svec__im[0] = 0.0f;
for (k = 1; k <
COR__BAND__START[NUM__OF__BANDS__FOR__COR__SEARCH];
k++)
{
    svec__re[k] = (fft__l[k] * fft__r[k])−(fft__l[L__FFT−k] *
    (−fft__r[L__FFT−k]));
    svec__im[k] = (fft__l[L__FFT−k] * fft__r[k]) + (fft__l[k] *
    (−fft__r[L__FFT−k]));
}
```

Figure 7:
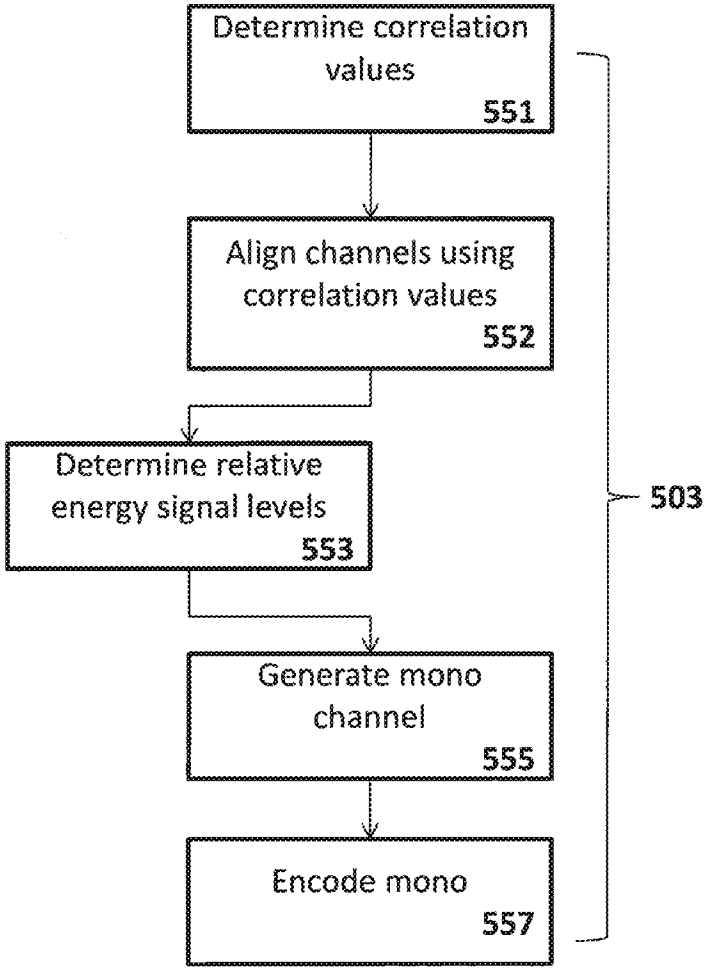
FIG. 7 shows a flow diagram illustrating the operation of the channel analyser as shown in FIG. 4 according to some embodiments.

The operation of determining the correlation values is shown in FIG. 7 by step 553.

The correlation/shift values can in some embodiments be passed to the mono channel generator/encoder and as stereo channel parameters to the quantizer optimiser.

Furthermore in some embodiments the correlation/shift value is applied to one of the audio channels to provide a temporal alignment between the channels. These aligned channel audio signals can in some embodiments be passed to a relative energy signal level determiner 301.

The operation of aligning the channels using the correlation/shift value is shown in FIG. 7 by step 552.

In some embodiments the channel analyser/encoder 203 comprises a relative energy signal level determiner 301. The relative energy signal level determiner 301 is configured to receive the output aligned frequency domain representations and determine the relative signal levels between pairs of channels for each sub-band. It would be understood that in the following examples a single pair of channels are analysed by a suitable stereo channel analyser and processed however it would be understood that in some embodiments this can be extended to any number of channels (in other words a multichannel analyser or suitable means for analysing multiple or two or more channels to determine parameters defining the channels or differences between the channels. This can be achieved for example by a suitable pairing of the multichannels to produce pairs of channels which can be analysed as described herein.

In some embodiments the relative level for each band can be computed using the following code.

```
For (j = 0; j < NUM__OF__BANDS__FOR__SIGNAL__LEVELS; j++)
    {
        mag__l = 0.0;
        mag__r = 0.0;
        for (k = BAND__START[j]; k < BAND__START[j+1]; k++)
        {
            mag__l += fft__l[k]*fft__l[k] +
            fft__l[L__FFT−k]*fft__l[L__FFT−k];
            mag__r += fft__r[k]*fft__r[k] +
            fft__r[L__FFT−k]*fft__r[L__FFT−k];
        }
        mag[j] =
        10.0f*log10(sqrt((mag__l+EPSILON)/(mag__r+EPSILON)));
    }
```

Where L_FFT is the length of the FFT and EPSILON is a small value above zero to prevent division by zero problems. The relative energy signal level determiner in such embodiments effectively generates magnitude determinations for each channel (L and R) over each sub-band and then divides one channel value by the other to generate a relative value. In some embodiments the relative energy signal level determiner 301 is configured to output the relative energy signal level to the encoding mode determiner 205.

The operation of determining the relative energy signal level is shown in FIG. 7 by step 553.

The relative energy signal level values can in some embodiments be passed to the mono channel generator/encoder and as stereo channel parameters to the quantizer optimiser.

In some embodiments any suitable inter level (energy) and inter temporal (correlation or delay) difference estimation can be performed. For example for each frame there can be two windows for which the delay and levels are estimated. Thus for example where each frame is 10 ms there may be two windows which may overlap and are delayed from each other by 5 ms. In other words for each frame there can be determined two separate delay and level difference values which can be passed to the encoder for encoding.

Furthermore in some embodiments for each window the differences can estimated for each of the relevant sub bands. The division of sub-bands can in some embodiments be determined according to any suitable method.

For example the sub-band division in some embodiments which then determines the number of inter level (energy) and inter temporal (correlation or delay) difference estimation can be performed according to a selected bandwidth determination. For example the generation of audio signals can be based on whether the output signal is considered to be wideband (WB), superwideband (SWB), or fullband (FB) (where the bandwidth requirement increases in order from wideband to fullband). For the possible bandwidth selections there can in some embodiments be a particular division in subbands. Thus for example the sub-band division for the FFT domain for temporal or delay difference estimates can be:

ITD sub-bands for Wideband (WB)

const short scale1024_WB[ ]={1, 5, 8, 12, 20, 34, 48, 56, 120, 512};

ITD sub-bands for Superwideband (SWB)

const short scale1024_SWB[ ]={1, 2, 4, 6, 10, 14, 17, 24, 28, 60, 256, 512};

ITD sub-bands for Fullband (FB)

const short scale1024_FB[ ]={1, 2, 3, 4, 7, 11, 16, 19, 40, 171, 341, 448/*~21 kHz*/};

ILD sub-bands for Wideband (WB)

const short scf_band_WB[ ]={1, 8, 20, 32, 44, 60, 90, 110, 170, 216, 290, 394, 512};

ILD sub-bands for Superwideband (SWB)

const short scf_band_SWB[ ]={1, 4, 10, 16, 22, 30, 45, 65, 85, 108, 145, 197, 256, 322, 412, 512};

ILD sub-bands for Fullband (FB)

const short scf_band_FB[ ]={1, 3, 7, 11, 15, 20, 30, 43, 57, 72, 97, 131, 171, 215, 275, 341, 391, 448/*~21 kHz*/};

In other words in some embodiments there can be different sub-bands for delays and levels differences.

In some embodiments the encoder 104 comprises a mono channel generator/encoder 305. The mono channel generator is configured to receive the channel analyser values such as the relative energy signal level from the relative energy signal level determiner 301 and the correlation/shift level from the correlation/shift determiner 303. Furthermore in some embodiments the mono channel generator/encoder 305 can be configured to further receive the input multichannel audio signals. The mono channel generator/encoder 305 can in some embodiments be configured to apply the delay and level differences to the multichannel audio signals to generate an 'aligned' channel which is representative of the audio signals. In other words the mono channel generator/encoder 305 can generate a mono channel signal which represents an aligned multichannel audio signal. For example in some embodiments where there is determined to be a left channel audio signal and a right channel audio signal one of the left or right channel audio signals are delayed with respect to the other according to the determined delay difference and then the delayed channel and other channel audio signals are averaged to generate a mono channel signal. However it would be understood that in some embodiments any suitable mono channel generating method can be implemented. It would be understood that in some embodiments the mono channel generator or suitable means for generating audio channels can be replaced by or assisted by a 'reduced' channel number generator configured to generate a smaller number of output audio channels than input audio channels. Thus for example in some multichannel audio signal examples where the number of input audio signal channels is greater than two the 'mono channel generator' is configured to generate more than one channel audio signal but fewer than the number of input channels.

The operation of generating a mono channel signal (or reduced number of channels) from a multichannel signal is shown in FIG. 7 by step 555.

The mono channel generator/encoder 305 can then in some embodiments encode the generated mono channel audio signal (or reduced number of channels) using any suitable encoding format. For example in some embodiments the mono channel audio signal can be encoded using an Enhanced Voice Service (EVS) mono channel encoded form, which may contain a bit stream interoperable version of the Adaptive Multi-Rate—Wide Band (AMR-WB) codec.

The operation of encoding the mono channel (or reduced number of channels) is shown in FIG. 7 by step 557.

The encoded mono channel signal can then be output. In some embodiments the encoded mono channel signal is output to a multiplexer to be combined with the output of the stereo parameter encoder 205 to form a single stream or output. In some embodiments the encoded mono channel signal is output separately from the stereo parameter encoder 205.

In some embodiments the encoder 104 comprises a multichannel parameter encoder. In some embodiments the multichannel parameter encoder is a stereo parameter encoder 205 or suitable means for encoding the multi-channel parameters. The stereo parameter encoder 205 can be configured to receive the multi-channel parameters such as the stereo (difference) parameters determined by the channel analyser/mono encoder 203. The stereo parameter encoder 205 can then in some embodiments be configured to perform a quantization on the parameters and furthermore encode the parameters so that they can be output (either to be stored on the apparatus or passed to a further apparatus).

The operation of quantizing and encoding the quantized stereo parameters is shown in FIG. 6 by step 505.

Figure 5:
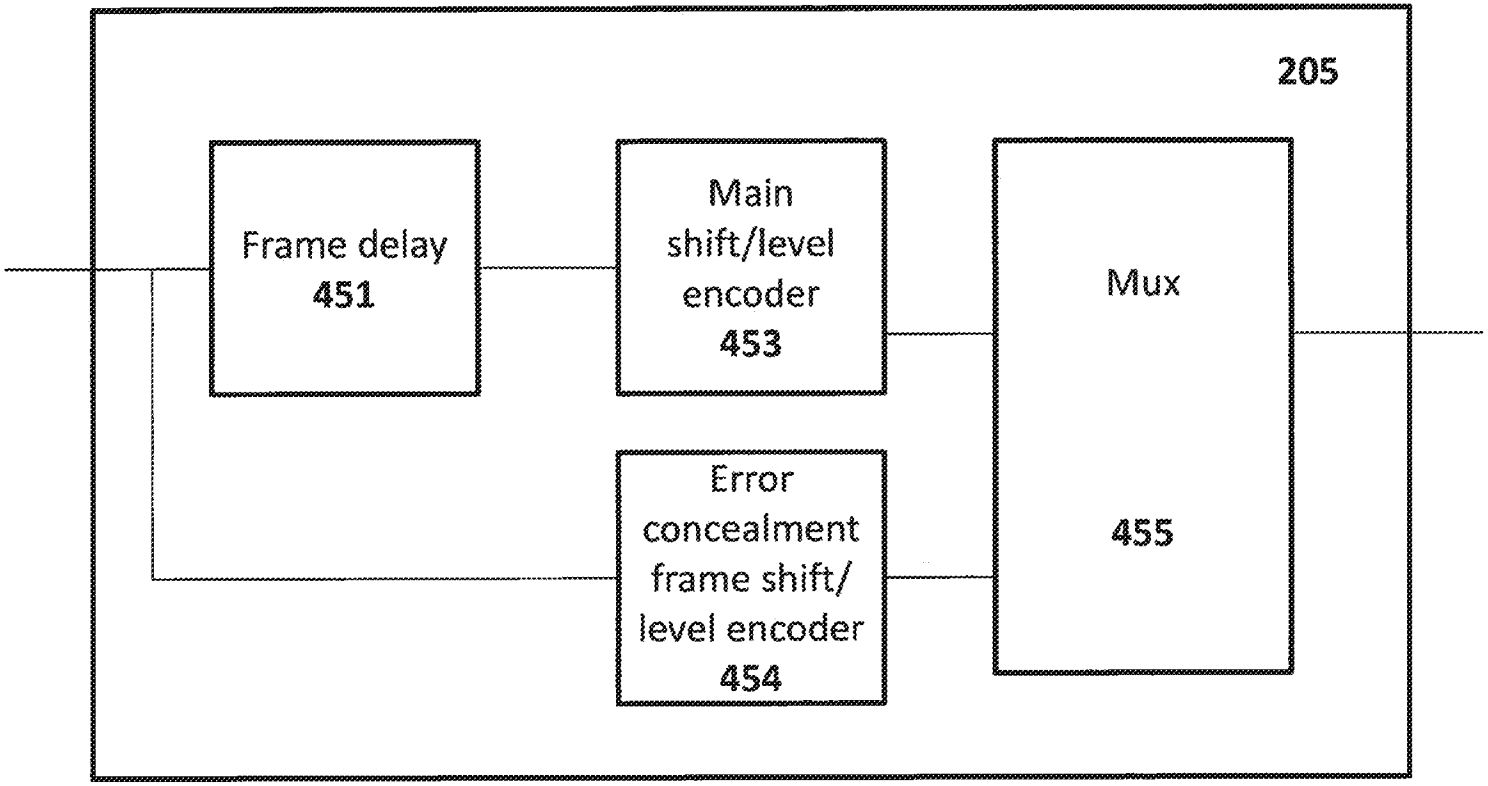
FIG. 5 shows schematically a stereo parameter encoder as shown in FIG. 3 in further detail according to some embodiments.

With respect to FIG. 5 an example stereo parameter encoder 205 is shown in further detail. Furthermore with respect to FIG. 10 the operation of the stereo parameter encoder 205 according to some embodiments is shown.

In some embodiments the stereo parameter encoder 205 is configured to receive the stereo parameters in the form of the channel level differences and the channel delay differences. The stereo parameters can in some embodiments be passed to both the frame delay 451 and the error concealment frame shift/level encoder 454.

The operation of receiving the stereo parameters is shown in FIG. 10 by step 901.

In some embodiments the stereo parameter encoder 205 comprises a frame delay 451. The frame delay 451 is configured to delay the stereo parameter information by a frame period. For example in some embodiments the frame delay period is 10 milliseconds (ms).

The operation of delaying the stereo parameters by a frame delay is shown in FIG. 10 by step 902.

The frame delayed stereo parameters can in some embodiments be passed to the main shift/level encoder 453.

In some embodiments the stereo parameter encoder 205 comprises a main shift/level encoder 453. The main shift/level encoder 453 can in some embodiments be configured to receive the frame delayed stereo parameters and be configured to generate encoded stereo parameters suitable for being output.

In some embodiments the stereo parameter encoder 205 comprises an error concealment shift/level encoder 454. The error concealment shift/level encoder 454 can in some embodiments be configured to receive the (un-delayed) stereo parameters and be configured to generate encoded stereo parameters suitable for being output and used as error concealment parameters where the main parameters are unavailable or corrupted.

It would be understood that in some embodiments the main shift/level encoder 454 and the error concealment shift/level encoder 454 can be implemented within the same element or elements. For example in some embodiments at the main shift/level encoder 454 can be implemented in hardware and/or software from which at least partially the error concealment shift/level encoder 454 is also implemented.

Figure 8:
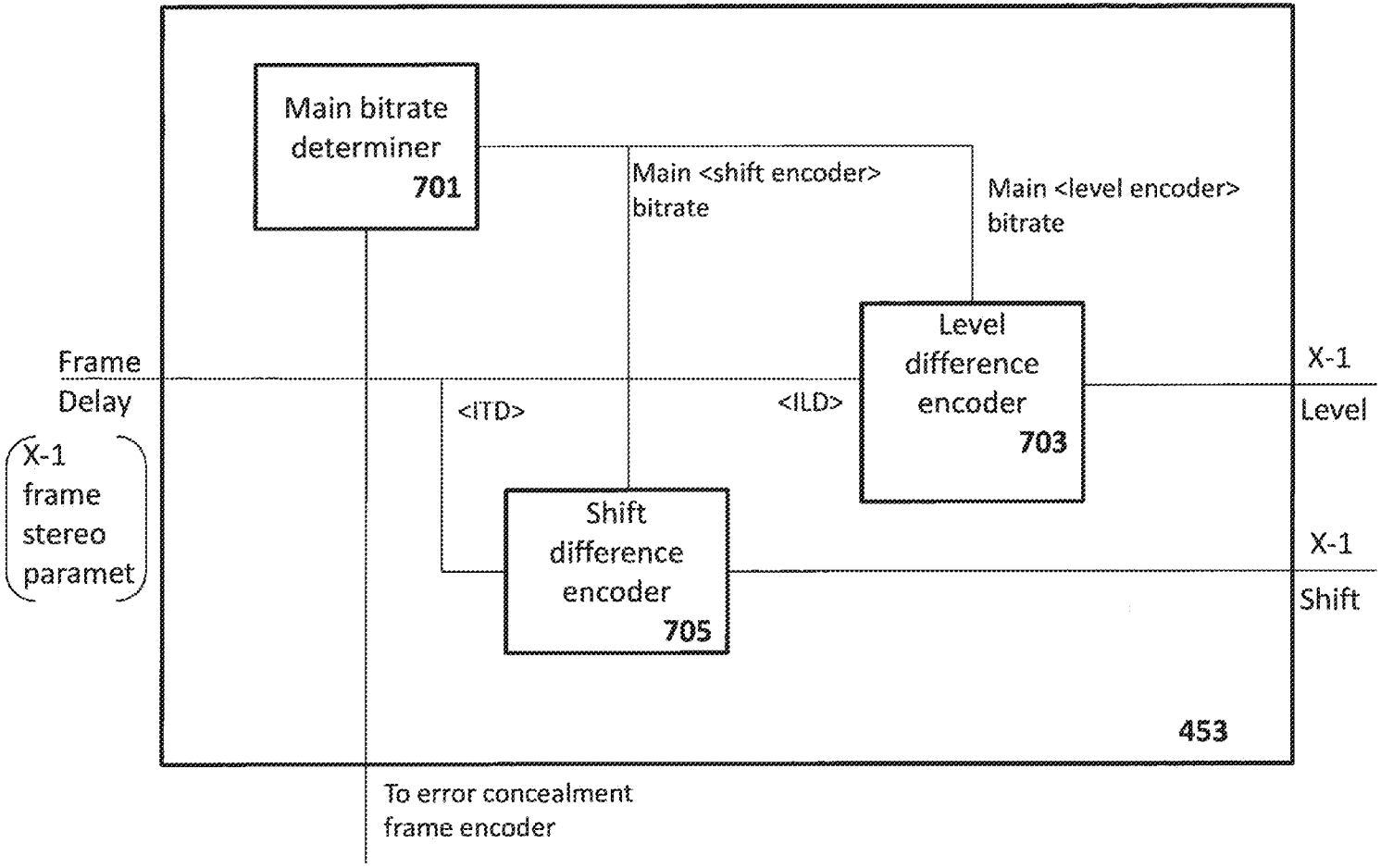
FIG. 8 shows schematically a main stereo parameter encoder as shown in FIG. 5 in further detail according to some embodiments.

With respect to FIG. 8 an example main shift/level encoder 453 is shown in further detail.

In some embodiments the main shift/level encoder 453 is configured to receive the frame delayed stereo parameters in the form of frame delayed channel level differences (ILD) and the channel delay differences (ITD).

In some embodiments the main shift/level encoder 453 comprises a main bit rate determiner 701. The main bitrate determiner 701 can be configured to receive or determine a fixed bit rate and divide the bit rate into encoding bits to be used encoding the frame delayed stereo parameters (in other words the main stereo encoding) and encoding bits to be used encoding the error concealment stereo parameters. Furthermore in some embodiments the main bitrate determiner 701 together with the error concealment bitrate determiner 801 within the error concealment frame shift/level encoder 454 can be configured to control the operations of the main shift difference encoder 705, the main level difference encoder 703, the error concealment shift difference encoder 805 and the error concealment level difference encoder 803.

The operation of determining the main encoding rate is shown in FIG. 10 by step 904.

In order to more fully explain the allocation of bit rate and control of the encoders by the main bitrate determiner 701 for main and error concealment encodings encoding of the stereo parameters is discussed herein.

In some embodiments the main shift/level encoder 453 comprises a shift (or correlation) difference encoder 705. The shift (or correlation) difference encoder 705 is configured to receive the frame delayed inter-time or inter-temporal difference (ITD) value from the stereo parameter input. Furthermore in some embodiments the shift (or correlation) difference encoder 705 is configured to receive an input from the main bitrate determiner 701 indicating how many bits are to be used to encode the delayed ITD values for each frame, or in other words the main shift difference encoding rate. In some embodiments the input from the main bitrate determiner 701 can further comprise indications enabling the shift difference encoder 705 to determine the encoding or variant of the encoding to be used.

The shift difference encoder 705 can then be configured to encode the shift difference (ITD) for the frame and output an encoded value.

In some embodiments only a defined number of the delay values are encoded. For example only the first 7 delay values are encoded. Therefore in such an example in total 14 delay values would be encoded per frame.

In some embodiments the delay values are vector quantized or encoded using 2 dimensional codebooks where the first dimension represents the first window of the frame and the second dimension represents the second window of the frame. In the example described herein where the first 7 delay values are encoded there are therefore required 7 2-dimensional codebooks.

In some embodiments the codebooks are defined with a maximum number of codevectors. It would be understood that the encoder would be configured to generate an indicator or signal associated with which codevector most closely represents the delay value pair. As there is a defined maximum number of codevectors this determines an upper limit for the number of bits required to signal a codevector from a codebook with a defined number of codevectors. For example where each codebook has a maximum of 32 codevectors there is required at most 5 bits to signal which of the codevectors is closest to the delay value pair.

However in some embodiments the shift difference encoder can be configured to encode the values in such a manner that the codevectors in each 2-dimensional codebook are ordered such that any sub-codebook containing codevectors from index 0 to index n−1 is a good codebook of n codevectors. In other words the shift difference encoder generates and implements a global-code book which combines the 7 2-dimensional codevectors. The combination can be any suitable mapping of codevectors, for example in some embodiments the codevectors for each difference pair are concatenated such that the codevectors for the first difference pair have a global codebook index values 1 to $N_1$ (where $N_1$ is the number of codevectors for the first difference pair), the codevectors for the second difference pair have a global codebook index values $N_1+1$ to $N_1+N_2$ (where $N_2$ is the number of codevectors for the second difference pair) and so on.

It would be understood that by combining the 7 2-dimensional codevectors into a global codebook it may be possible to signal the codevectors with the same quantization resolution using fewer bits. Furthermore by selectively combining codevectors from each of the codebooks the number of bits required can further be reduced. For example where the vector quantization shows that there is a very low frequency of occurrence of extreme outliers then the codevectors associated with centroid vectors are selected to be used in the global codebook.

For example whereas 7 codebooks signalled using 5 bits per codebook uses 35 bits where the first 5 codebooks each contain 11 codevectors and the last 2 codebooks contain 10 codevectors by combining them into a single global codebook then each individual codevector can be identified using 24 bits.

Or in other words where the main bitrate determiner 701 is configured to indicate that rather than the maximum number of bits per frame can be used to represent the difference pairs (for example 35 bits), fewer bits are available (for example 24 bits), then the shift difference encoder 705 can in some embodiments be configured to allocate a number of codevectors to each difference pair (or difference pair codebook) which are globally indexed with other allocated codevectors from other codebooks. In some embodiments the shift difference encoder 705 can be configured to select a number of codevectors from the initial codebook which are then globally indexed in the global codebook with the other selected codevectors from other codebooks. Thus for example the shift difference encoder can allocate 24 bits per frame which are allocated across the original codebooks according to the following distribution −11 codevectors from the first 5 codebooks and 10 codevectors used from the last 2 codebooks because log 2((11^5)×(10^2))=23.941.

In some embodiments the shift difference encoder 705 can be configured to determine the allocation of the number of bits to determine how many codevectors are used from each codebook using the following expression $$x(i)=\text{ceil}(\log 2(i\hat{}7))\text{ should be stored in memory.}$$

where i is the number of codevectors per codebook to be selected for the global codebook, x is the number of bits needed to select from the global codebook. Thus for example for the following vector of values of i there are associated vector of x i=[1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32]

x=[0, 7, 12, 14, 17, 19, 20, 21, 23, 24, 25, 26, 26, 27, 28, 28, 29, 30, 30, 31, 31, 32, 32, 33, 33, 33, 34, 34, 35, 35, 35, 35]

or alternatively a variable y(i) specifying how many codevectors can be used by one codebook if there are i bits:

i=[0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35]

y=[1, 1, 1, 1, 1, 1, 1, 2, 2, 2, 2, 2, 3, 3, 3, 4, 4, 5, 5, 6, 7, 8, 8, 9, 10, 11, 13, 14, 16, 17, 18, 21, 23, 26, 28, 32];

For example, as discussed above with an allocation of 24 bits the number of codevectors value y(24)=10.

In some embodiments the shift difference encoder can further be configured to perform a secondary allocation of codevectors to attempt to further increase the number of selected codevectors. In some embodiments this can be performed by adding an additional codevector from each codebook in turn. For example the codebooks codevector configurations allocated according to the initial allocation are:

[10 10 10 10 10 10 10]->23.25 bits per frame then an additional codevector from the first codebook is selected

[11 10 10 10 10 10 10]->23.40 bits per frame an additional codevector from the second codebook is selected

[11 11 10 10 10 10 10]->23.53 bits per frame and so on until the bit allocation limit is reached

[11 11 11 10 10 10 10]->23.67 bits per frame

[11 11 11 11 10 10 10]->23.80 bits per frame

[11 11 11 11 11 10 10]->23.94 bits per frame

[11 11 11 11 11 11 10]->24.08 bits per frame

As the last variant used over 24 bits per frame, the most efficient is the penultimate variant where there 11 codevectors in the first 5 codebooks and 10 in the remaining two.

In some embodiments the shift difference encoder 705 can be configured to perform the encoding of the shift difference values according to any suitable manner and using the codevector index for each of the codebooks generate a global codebook index as a main encoded shift difference value.

The combination of the codebooks can be any suitable encoding as described herein.

For example the global codevector can in some embodiments be determined by the following expression $$I=I_1*N_2*\ldots*N_{n-1}*N_n+\ldots+I_{n-2}*N_{n-1}*N_n+I_{n-1}*N_n+I_n$$

where $I_1$ to $I_n$ defines the codevector index from each of the codebooks and $N_2$ to $N_n$ the number of codevectors in each codebook.

For example in some embodiments where the index obtained for each codebook are respectively $I_1, I_2, I_3, I_4, I_5, I_6, I_7$ the resulting index of the global 14 dimensional codevector can in some embodiments be determined by the following expression:

$$I=I_1*11\hat{}4*10\hat{}2+I_2*11\hat{}3*10\hat{}2+I_3*11\hat{}2*10\hat{}2+I_4*11*10\hat{}2+I_5*10\hat{}2+I_6*10+I_7.$$

The global codevector value for the frame can then be output as a delayed frame (X−1) encoded shift difference value and passed to the multiplexer 455.

The operation of encoding the main shift difference value is shown in FIG. 10 by step 906.

In some embodiments the main shift/level encoder 453 comprises a level difference encoder 703. The level difference encoder 703 is configured to receive the frame delayed level or power difference (ILD) value from the stereo parameter input. Furthermore in some embodiments the level difference encoder 703 is configured to receive an input from the main bitrate determiner 701 indicating how many bits are to be used to encode the delayed ILD values for each frame, or in other words the main level difference encoding rate. In some embodiments the input from the main bitrate determiner 701 can further comprise indications enabling the level difference encoder 703 to determine the encoding or variant of the encoding to be used.

The level difference encoder 703 can then be configured to encode the level difference (ILD) for the frame and output an encoded value.

In some embodiments the level difference encoder is configured to encode both windows as a vector quantization. The number of level differences to be encoded depends on the signal bandwidth (2×12(WB), 2×15(SWB), 2×17(FB)). In some embodiments the main bitrate determiner can be configured to indicate the number of bits per frame allocated to the level difference encoder as a factor of the number of bits per frame allocated to the shift difference encoder. For example ⅓ of the bits allocated to the shift difference encoder and ⅔ of the bits allocated to the level difference encoder. In such an example the number of bits allocated to encode the level difference is twice that of the shift difference encoding. Using the examples discussed herein this can be for example 70 bits per frame where the shift difference encoder is allocated 35 bits per frame. However in some embodiments, for example where the number of bits allocated to the shift difference is 24 bits per frame then the level difference encoder is allocated 48 bits per frame to encode the level differences.

However it is possible that a number of bits allocated for level difference encoding can be reduced from the normal.

For example in some embodiments the level difference encoder can be configured to use index remapping based on a determined frequency of occurrence and Golomb-Rice encoding (or and other suitable entropy coding) the index value the number of bits required to encode each value can on average be reduced.

Thus in an ideal case the number of bits used to represent the level differences in a frame for each sub-band is 1 per symbol. For example in such situations the level difference encoder can be configured to use 30 bits in the SWB mode of operation 15 sub-bands×2 windows per frame×1 bit for encoding most common level difference.

Figure 13:
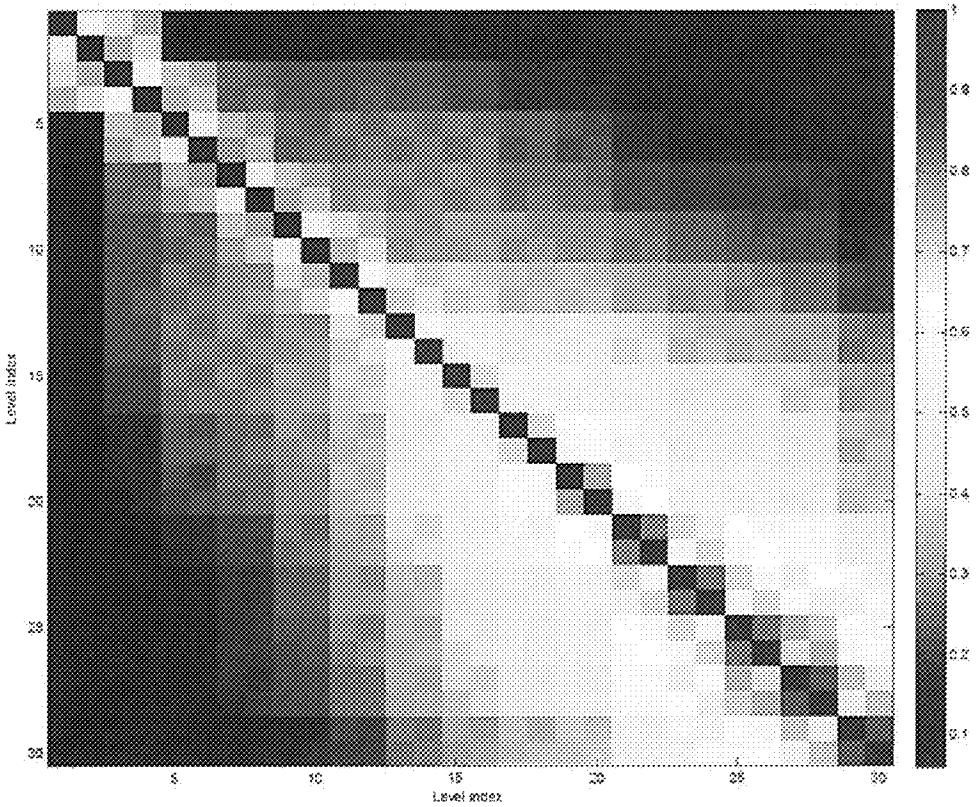
FIG. 13 shows a graphical representation of example normalised cross correlation between level values from different sub-bands according to some embodiments.

In some embodiments the correlation between level differences within a frame can be exploited. As shown in FIG. 13 the correlation between level coefficients is such that the level values corresponding to higher frequencies are highly correlated and also that values corresponding to the same position but from different windows are highly correlated. This for example can in some embodiments be exploited by the level difference encoder to encode only the values from one of the two windows (which when received at the decoder is replicated as the other window value, cutting approximately by half the bitrate required.

Figure 14:
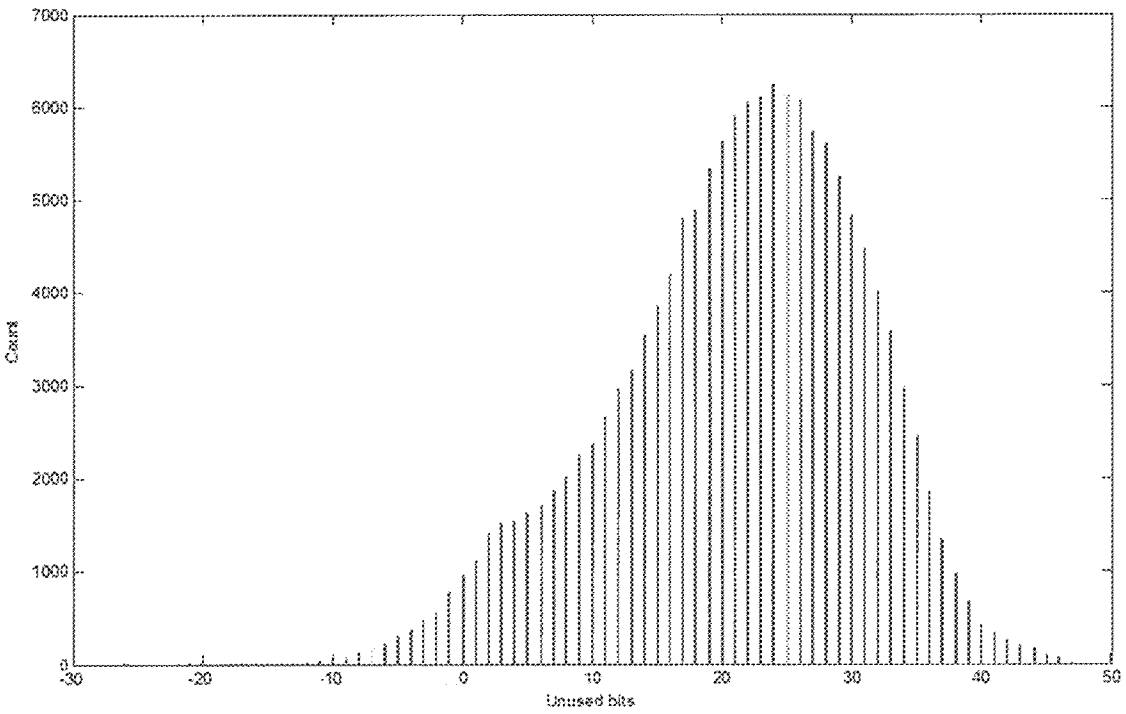
FIG. 14 shows a histogram of unused bits from a total bitrate of 6 kbps in example implementations of some embodiments.

Furthermore as shown in FIG. 14 the average number of extra bits is approximately 25 bits for delays and levels.

In some embodiments the level difference encoder can furthermore be configured to encode differential level difference values on a frame by frame basis rather than absolute level difference values. These differential values can in some embodiments be further index mapped and Golomb-Rice (or and other suitable entropy coding).

In some embodiments the level difference encoder can be configured to decrease the quantization resolution and by using fewer representation levels permits encoding the values with fewer bits.

The level difference encoder can thus be configured to use fewer bits and thus when combined with the number of bits used by the shift difference encoder 705 use the bits allocated by the main bitrate determiner 701 (which is fewer than the total number of bits allocated for the stereo parameters per frame).

In some embodiments the level difference encoder can be configured not only to receive an allocation of bits with which to encode the level difference encoder but be further configured to pass to the main bitrate determiner an indication of the number of bits used for the current delayed frame for encoding the main level difference.

The encoded level difference values for the frame can then be output as a delayed frame (X−1) encoded level difference value and passed to the multiplexer 455.

The operation of encoding the main level difference values is shown in FIG. 10 by step 908.

Figure 9:
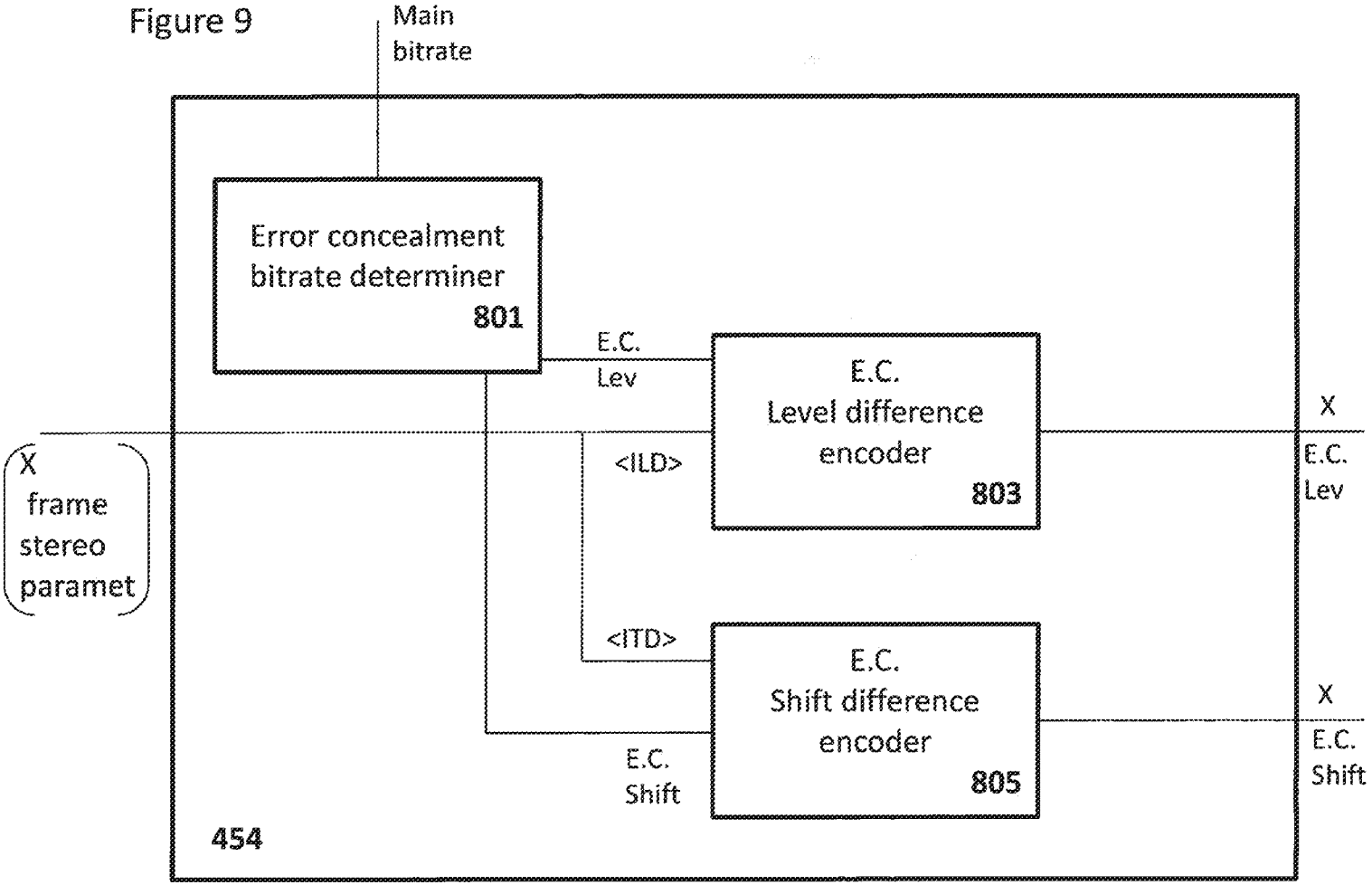
FIG. 9 shows schematically an error concealment stereo parameter encoder as shown in FIG. 5 in further detail according to some embodiments.

With respect to FIG. 9 an example error concealment shift/level encoder 454 is shown in further detail.

In some embodiments the error concealment shift/level encoder 454 is configured to receive the stereo parameters in the form of channel level differences (ILD) and the channel delay differences (ITD).

In some embodiments the error concealment shift/level encoder 454 comprises an error concealment bit rate determiner 801. The error concealment bitrate determiner 801 can be configured to receive or determine a the difference between the fixed or allocated bit rate for encoding the stereo parameters for frame and the bit rate used encoding the frame delayed stereo parameters (in other words the main stereo encoding) to determine the number of encoding bits to be used encoding the error concealment stereo parameters. Furthermore as discussed herein in some embodiments the error concealment bitrate determiner 801 can be configured to control the operations of the error concealment shift difference encoder 805 and the error concealment level difference encoder 803.

The operation of determining the error concealment encoding rate is shown in FIG. 10 by step 905.

In some embodiments the error concealment shift/level encoder 454 comprises a error concealment (e.c.) shift (or correlation) difference encoder 805. The e.c. shift (or correlation) difference encoder 805 is configured to receive the inter-time or inter-temporal difference (ITD) value from the stereo parameter input. Furthermore in some embodiments the e.c. shift (or correlation) difference encoder 805 is configured to receive an input from the e.c. bitrate determiner 801 indicating how many bits are to be used to encode the ITD values for each frame, or in other words the e.c. shift difference encoding rate. In some embodiments the input from the e.c. bitrate determiner 801 can further comprise indications enabling the e.c. shift difference encoder 805 to determine the encoding or variant of the encoding to be used.

The e.c. shift difference encoder 805 can then be configured to encode the shift difference (ITD) for the frame and output an encoded value.

In a manner similar to that described herein with respect to the main encoder in some embodiments only a defined number of the delay values are encoded. For example only the first 7 delay values are encoded. Therefore in such an example in total 14 delay values would be encoded per frame.

In some embodiments the delay values are vector quantized or encoded using 2 dimensional codebooks where the first dimension represents the first window of the frame and the second dimension represents the second window of the frame. In the example described herein where the first 7 delay values are encoded there are therefore required 7 2-dimensional codebooks.

In some embodiments the codebooks are defined with a maximum number of codevectors. It would be understood that the encoder would be configured to generate an indicator or signal associated with which codevector most closely represents the delay value pair. As there is a defined maximum number of codevectors this determines an upper limit for the number of bits required to signal a codevector from a codebook with a defined number of codevectors. In some embodiments this number of codevectors and therefore the number of bits required is fewer than the main shift difference encoder.

Furthermore in some embodiments a similar approach as applied to the main encoder can be applied with respect to the e.c. shift difference encoder where the codevectors in each 2-dimensional codebook are ordered such that any sub-codebook containing codevectors from index 0 to index n−1 is a good codebook of n codevectors. In other words the shift difference encoder generates and implements a global-code book which combines the various 2-dimensional codevectors. The combination can be any suitable mapping of codevectors, for example in some embodiments the codevectors for each difference pair are concatenated such that the codevectors for the first difference pair have a global codebook index values 1 to $N_1$ (where $N_1$ is the number of codevectors for the first difference pair), the codevectors for the second difference pair have a global codebook index values $N_1+1$ to $N_1+N_2$ (where $N_2$ is the number of codevectors for the second difference pair) and so on.

The global codevector value for the in such embodiments frame can then be output as a frame (X) encoded shift difference value and passed to the multiplexer 455.

The operation of encoding the error concealment shift difference value is shown in FIG. 10 by step 907.

In some embodiments the e.c. shift/level encoder 454 comprises an error concealment (e.c.) level difference encoder 803. The e.c. level difference encoder 803 is configured to receive the level or power difference (ILD) value from the stereo parameter input. Furthermore in some embodiments the e.c. level difference encoder 803 is configured to receive an input from the e.c bitrate determiner 801 indicating how many bits are to be used to encode the ILD values for each frame, or in other words the e.c level difference encoding rate. In some embodiments the input from the e.c. bitrate determiner 801 can further comprise indications enabling the e.c. level difference encoder 803 to determine the encoding or variant of the encoding to be used.

The e.c. level difference encoder 803 can then be configured to encode the level difference (ILD) for the frame and output an encoded value.

In some embodiments the e.c. level difference encoder 803 is configured to encode both windows as a vector quantization. The number of level differences to be encoded depends on the signal bandwidth (2×12(WB), 2×15(SWB), 2×17(FB)).

In some embodiments the e.c bitrate determiner 801 can be configured to indicate the number of bits per frame allocated to the e.c. level difference encoder 803 as a factor of the number of bits per frame allocated to the e.c. shift difference encoder 805. For example ⅓ of the bits allocated to the e.c. shift difference encoder and ⅔ of the bits allocated to the e.c. level difference encoder. In such an example the number of bits allocated to encode the e.c. level difference is twice that of the e.c. shift difference encoding.

However in a manner similar to that described herein with respect to the main level difference encoder the e.c. level difference encoder can be configured to attempt to improve the quality of the encoding from the number of bits allocated for level difference encoding.

For example in some embodiments the e.c. level difference encoder can be configured to use index remapping based on a determined frequency of occurrence and Golomb-Rice encoding (or and other suitable entropy coding) the index value the number of bits required to encode each value can on average be reduced.

In some embodiments the correlation between level differences within a frame can be exploited.

In some embodiments the e.c. level difference encoder can furthermore be configured to encode differential level difference values on a frame by frame basis rather than absolute level difference values. These differential values can in some embodiments be further index mapped and Golomb-Rice (or and other suitable entropy coding).

In some embodiments the e.c. level difference encoder can be configured to decrease the quantization resolution and by using fewer representation levels permits encoding the values with fewer bits.

The encoded level difference values for the frame can then be output as a frame (X) encoded level difference value and passed to the multiplexer 455.

The operation of encoding the e.c. level difference values is shown in FIG. 10 by step 909.

In some embodiments the stereo parameter encoder 205 can comprise an multiplexer configured to combine the output of the main and e.c. stereo parameters and output a combined encoded stereo parameter.

The operation of outputting the encoded differences or stereo parameters for the main (frame delayed) and e.c. parameters is shown in FIG. 10 by step 910.

In order to fully show the operations of the codec FIGS. 11 and 12 show a decoder and the operation of the decoder according to some embodiments. In the following example the decoder is a stereo decoder configured to receive a mono channel encoded audio signal and stereo channel extension or stereo parameters, however it would be understood that the decoder is configured to receive any number of channel encoded audio signals and channel extension parameters.

In some embodiments the decoder 108 comprises a mono channel decoder 1001. The mono channel decoder 1001 is configured in some embodiments to receive the encoded mono channel signal.

The operation of receiving the encoded mono channel audio signal is shown in FIG. 12 by step 1101.

Furthermore the mono channel decoder 1001 can be configured to decode the encoded mono channel audio signal using the inverse process to the mono channel coder shown in the encoder.

The operation of decoding the mono channel is shown in FIG. 12 by step 1103.

In some embodiments the mono channel decoder 1001 can be configured to determine whether the current frame mono channel audio signal is corrupted or missing. For example where each frame is received as a packet and the current packet is missing (and thus there is no current frame mono channel audio signal), or there is data corruption in the mono channel audio signal. In such embodiments the mono channel decoder 1001 can be configured to generate a suitable mono channel audio signal frame (or more than one channel audio signal frame) from previous frame(s) mono channel audio signals. For example in some embodiments an error compensation processing of the previous frame mono channel audio signal can be performed. In some embodiments this can be using the previous frame mono channel audio signal for the current frame.

In some embodiments the decoder further comprises a frame delay/synchroniser (mono) 1002 configured to receive the output of the mono decoder 1001 and output the decoded mono signal to the stereo channel generator 1009 such that the decoded mono signal is synchronised or received substantially at the same time as the decoded stereo parameters from the error concealment demultiplexer 1007.

In some embodiments the decoder 108 can comprise a stereo channel decoder 1003. The stereo channel decoder 1003 is configured to receive the encoded stereo parameters.

The operation of receiving the encoded stereo parameters is shown in FIG. 12 by step 1102.

Furthermore the stereo channel decoder 1003 can be configured to decode the stereo channel signal parameters by applying the inverse processes to that applied in the encoder. For example the stereo channel decoder can be configured to output decoded main stereo parameters by applying the reverse of the main shift difference encoder and main level difference encoder and output decoded e.c. stereo parameters by applying the reverse of the e.c. shift difference encoder and e.c. level difference encoder.

The operation of decoding the stereo parameters is shown in FIG. 12 by step 1104.

The stereo channel decoder 1103 is further configured to output the decoded main stereo parameters to an error concealment demultiplexer 1007 and the decoded e.c. stereo parameters to a frame delay/synchronizer (stereo) 1005.

In some embodiments the decoder comprises a frame delay/synchronizer (stereo) 1005. The frame delay/synchronizer (stereo) 1005 can in some embodiments be configured to receive the output of the stereo channel decoder 1003 e.c. parameters and output the e.c. parameters to an error concealment dumultiplexer 1007 such that the decoded e.c. parameters are synchronised in terms of frame count index with the decoded main stereo parameters.

The operation of delaying the e.c. parameters is shown in FIG. 12 by step 1106.

In some embodiments the decoder comprises an error concealment demultiplexer 1007. The error concealment demultiplexer 1007 is configured to receive the stereo parameters with respect to a common frame for both the main and e.c stereo parameters and configured to determine whether the main stereo parameters for the frame have been received. In other words are the main stereo parameters for the current frame missing or corrupted.

The operation of determining whether the main stereo parameters have been received is shown in FIG. 12 by step 1107.

In some embodiments the error concealment demultiplexer is configured to output the main stereo parameters when the error concealment demultimplexer 1007 determines that the main stereo parameters are present or have been received.

The operation of outputting or selecting the main stereo parameters to output after determining the main stereo parameters have been received is shown in FIG. 12 by step 1109.

In some embodiments the error concealment demultiplexer is configured to output the e.c. stereo parameters when the error concealment demultimplexer 1007 determines that the main stereo parameters are not present or have not been received or are significantly corrupted.

The operation of outputting or selecting the e.c. stereo parameters to output after determining the main stereo parameters are missing or not been received is shown in FIG. 12 by step 1111.

In some embodiments the decoder comprises a stereo channel generator 1009 configured to receive the decoded stereo parameters and the decoded mono channel and regenerate the stereo channels in other words applying the level differences to the mono channel to generate a second channel.

The operation of generating the stereo channels from the mono channel and stereo parameters is shown in FIG. 12 by step 1009.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

determining a first coding bitrate for at least one first frame audio signal multi-channel parameter and a second coding bitrate for at least one second frame audio signal multi-channel parameter, wherein the combined first and second coding bitrate is less than a bitrate limit;

determining for a first frame the at least one first frame audio signal multi-channel parameter;

generating an encoded first frame audio signal multi-channel parameter within the first coding bitrate from the at least one first frame audio signal multi-channel parameter;

determining for a second frame the at least one second frame audio signal multi-channel parameter;

generating an encoded at least one second frame audio signal multi-channel parameter within the second coding bitrate from the at least one second frame audio signal multi-channel parameter; and combining the encoded at least one first frame audio signal multi-channel parameter and the encoded at least one second frame audio signal multi-channel parameter, wherein generating an encoded first frame audio signal multi-channel parameter within the first coding bitrate from the at least one first frame audio signal multi-channel parameter or generating an encoded second frame audio signal multi-channel parameter within the second coding bitrate from the at least one second frame audio signal multi-channel parameter comprises:

generating codebook indices for groups of the at least one first frame audio signal multi-channel parameter or the at least one second frame audio signal multi-channel parameter respectively using separate vector quantization codebooks;

generating a combined vector quantization codebook from the separate vector quantization codebooks; and generating a combined vector quantization index for the combined vector quantization codebook from the codebook indices for groups, wherein the number of bits used to identify the combined vector quantization index is fewer than a combined number of bits used by the codebook indices for the separate groups.

2. The method as claimed in claim 1, wherein the first frame is at least one of:

adjacent to the second frame; and preceding the second frame.

3. The method as claimed in claim 1, wherein determining for a first frame the at least one first frame audio signal multi-channel parameter or determining for a second frame the at least one second frame audio signal multi-channel parameter comprises determining at least one of:

at least one interaural time difference; and at least one interaural level difference.

4. The method as claimed in claim 1, wherein generating a combined vector quantization codebook from the separate quantization codebooks comprises:

selecting from the separate vector quantization codebooks at least one codevector; and combining the at least one codevector from the separate vector quantization codebooks.

5. The method as claimed in claim 4, wherein selecting from the separate vector quantization codebooks at least one codevector comprises:

determining a first number of codevectors to be selected from the separate vector quantization codebooks; and increasing the first number until the first or second respective encoding bitrate is reached.

6. The method as claimed in claim 1, wherein generating an encoded first frame audio signal multi-channel parameter within the first coding bitrate from the at least one first frame audio signal multi-channel parameter comprises:

generating a first encoding mapping with an associated index for the at least one first frame audio signal multi-channel parameter dependent on a frequency distribution of mapping instances of the at least one first frame audio signal multi-channel parameter; and encoding the first encoding mapping dependent on the associated index.

7. The method as claimed in claim 6, wherein encoding the first encoding mapping dependent on the associated index comprises applying a Golomb-Rice encoding to the first encoding mapping dependent on the associated index.

8. The method as claimed in claim 1, wherein generating an encoded second frame audio signal multi-channel parameter within the second coding bitrate from the at least one second frame audio signal multi-channel parameter comprises:

generating a second encoding mapping with an associated index for the at least one second frame audio signal multi-channel parameter dependent on a frequency distribution of mapping instances of the at least one second frame audio signal multi-channel parameter; and encoding the second encoding mapping dependent on the associated index.

9. The method as claimed in claim 8, wherein encoding the second encoding mapping dependent on the associated index comprises applying a Golomb-Rice encoding to the second encoding mapping dependent on the associated index.

10. The method as claimed in claim 1, further comprising:

receiving at least two audio signal channels;

determining a fewer number of channels audio signal from the at least two audio signal channels and the at least one first frame audio signal multi-channel parameter;

generating an encoded audio signal comprising the fewer number of channels within a packet mono bitrate limit;

combining the encoded audio signal, the encoded at least one first frame audio signal multi-channel parameter and the encoded at least one second frame audio signal multi-channel parameter.

11. A method comprising:

receiving within a first period a encoded audio signal comprising at least one first frame audio signal, at least one first frame audio signal multi-channel parameter and at least one further frame audio signal multi-channel parameter and receiving within a further period a further encoded audio signal comprising at least one further frame audio signal;

determining whether the further encoded audio signal comprises at least one further frame audio signal multi-channel parameter and/or the at least one further frame audio signal multi-channel parameter is corrupted; and generating for the further frame at least two channel audio signals from either of the at least one first frame audio signal or the at least one further frame audio signal, and the encoded audio signal at least one further frame audio signal multi-channel parameter when the further encoded audio signal does not comprise at least one further frame audio signal multi-channel parameter or the at least one further frame audio signal multi-channel parameter is corrupted.

12. The method as claimed in claim 11, further comprising generating for the further frame at least two channel audio signals from the further frame audio signal and the further encoded audio signal at least one further frame audio signal multi-channel parameter when the further encoded audio signal comprises the at least one further frame audio signal multi-channel parameter and the at least one further frame audio signal multi-channel parameter is not corrupted.

13. An apparatus comprising at least one processor and at least one memory including computer program code for one or more programs, the at least one memory and the computer program code configured to, with the at least one processor, cause the apparatus at least to:

determine a first coding bitrate for at least one first frame audio signal multi-channel parameter and a second coding bitrate for at least one second frame audio signal multi-channel parameter, wherein the combined first and second coding bitrate is less than a bitrate limit;

determine for a first frame the at least one first frame audio signal multi-channel parameter;

generate an encoded first frame audio signal multi-channel parameter within the first coding bitrate from the at least one first frame audio signal multi-channel parameter;

determine for a second frame the at least one second frame audio signal multi-channel parameter;

generate an encoded at least one second frame audio signal multi-channel parameter within the second coding bitrate from the at least one second frame audio signal multi-channel parameter; and combine the encoded at least one first frame audio signal multi-channel parameter and the encoded at least one second frame audio signal multi-channel parameter, wherein the apparatus caused to generate an encoded first frame audio signal multi-channel parameter within the first coding bitrate from the at least one first frame audio signal multi-channel parameter or generate an encoded second frame audio signal multi-channel parameter within the second coding bitrate from the at least one second frame audio signal multi-channel parameter causes the apparatus to:

generate codebook indices for groups of the at least one first frame audio signal multi-channel parameter or the at least one second frame audio signal multi-channel parameter respectively using separate vector quantization codebooks;

generate a combined vector quantization codebook from the separate vector quantization codebooks; and generate a combined vector quantization index for the combined vector quantization codebook from the codebook indices for groups, wherein the number of bits used to identify the combined vector quantization index is fewer than a combined number of bits used by the codebook indices for the separate groups.

14. The apparatus as claimed in claim 13, wherein the first frame is at least one of:

adjacent to the second frame; and preceding the second frame.

15. The apparatus as claimed in claim 13, wherein the apparatus is caused to determine for a first frame the at least one first frame audio signal multi-channel parameter or determine for a second frame the at least one second frame audio signal multi-channel parameter causes the apparatus to determine at least one of:

at least one interaural time difference; and at least one interaural level difference.

16. The apparatus as claimed in claim 13, wherein the apparatus caused to generate a combined vector quantization codebook from the separate quantization codebooks causes the apparatus to:

select from the separate vector quantization codebooks at least one codevector; and combine the at least one codevector from the separate vector quantization codebooks.

17. The apparatus as claimed in claim 16, wherein the apparatus caused to selecting from the separate vector quantization codebooks at least one codevector causes the apparatus to:

determine a first number of codevectors to be selected from the separate vector quantization codebooks; and increase the first number until the first or second respective encoding bitrate is reached.

18. The apparatus as claimed in claim 13, wherein the apparatus caused to generate an encoded first frame audio signal multi-channel parameter within the first coding bitrate from the at least one first frame audio signal multi-channel parameter causes the apparatus to:

generate a first encoding mapping with an associated index for the at least one first frame audio signal multi-channel parameter dependent on a frequency distribution of mapping instances of the at least one first frame audio signal multi-channel parameter; and encode the first encoding mapping dependent on the associated index.

19. The apparatus as claimed in claim 18, wherein the apparatus caused to encode the first encoding mapping dependent on the associated index causes the apparatus to apply a Golomb-Rice encoding to the first encoding mapping dependent on the associated index.

20. The apparatus as claimed in claim 13, wherein the apparatus caused to generate an encoded second frame audio signal multi-channel parameter within the second coding bitrate from the at least one second frame audio signal multi-channel parameter causes the apparatus to:

generate a second encoding mapping with an associated index for the at least one second frame audio signal multi-channel parameter dependent on a frequency distribution of mapping instances of the at least one second frame audio signal multi-channel parameter; and encode the second encoding mapping dependent on the associated index.

21. The apparatus as claimed in claim 20, wherein the apparatus caused to encode the second encoding mapping dependent on the associated index causes the apparatus to apply a Golomb-Rice encoding to the second encoding mapping dependent on the associated index.

22. The apparatus as claimed in claim 13, wherein the apparatus is further caused to:

receive two or more audio signal channels;

determine a fewer number of channels audio signal from the two or more audio signal channels and the at least one first frame audio signal multi-channel parameter;

generate an encoded audio signal within a packet bitrate limit; combine the encoded audio signal, the encoded at least one first frame audio signal multi-channel parameter and the encoded at least one second frame audio signal multi-channel parameter.

23. An apparatus comprising at least one processor and at least one memory including computer program code for one or more programs, the at least one memory and the computer program code configured to, with the at least one processor, cause the apparatus at least to:

receive within a first period an encoded audio signal comprising at least one first frame audio signal, at least one first frame audio signal multi-channel parameter and at least one further frame audio signal multi-channel parameter and receive within a further period a further encoded audio signal comprising at least one further frame audio signal;

determine whether the further encoded audio signal comprises at least one further frame audio signal multi-channel parameter and/or the at least one further frame audio signal multi-channel parameter is corrupted; and generate for the further frame at least two channel audio signals from either of the at least one first frame audio signal or the at least one further frame audio signal, and the encoded audio signal at least one further frame audio signal multi-channel parameter when the further encoded audio signal does not comprise at least one further frame audio signal multi-channel parameter or the at least one further frame audio signal multi-channel parameter is corrupted.

24. The apparatus as claimed in claim 23, wherein the apparatus is further caused to generate for the further frame at least two channel audio signals from the at least one further frame audio signal and the further encoded audio signal at least one further frame audio signal multi-channel parameter when the further encoded audio signal comprises the at least one further frame audio signal multi-channel parameter and the at least one further frame audio signal multi-channel parameter is not corrupted.

* * * * *